US010737519B2

(12) United States Patent
Tonishi et al.

(10) Patent No.: US 10,737,519 B2
(45) **Date of Patent: *Aug. 11, 2020**

(54) RIBBON CASSETTE INCLUDING INK RIBBON, FIRST SPOOL, AND SECOND SPOOL

(71) Applicant: Brother Kogyo Kabushiki Kaisha, Nagoya-shi, Aichi-ken (JP)

(72) Inventors: Hisako Tonishi, Aichi-gun (JP); Tsutomu Kato, Nagoya (JP); Susumu Murata, Konan (JP); Akiko Kodama, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/214,230

(22) Filed: Dec. 10, 2018

(65) Prior Publication Data

US 2019/0105931 A1 Apr. 11, 2019

Related U.S. Application Data

(63) Continuation of application No. 15/718,232, filed on Sep. 28, 2017, now Pat. No. 10,166,800, which is a (Continued)

(30) Foreign Application Priority Data

Jul. 13, 2015 (JP) ..... 2015-139561
Jul. 13, 2015 (JP) ..... 2015-139567

(51) Int. Cl.
*B41J 32/00* (2006.01)
*B41J 17/30* (2006.01)
(Continued)

(52) U.S. Cl.
CPC ..... *B41J 32/00* (2013.01); *B41J 2/32* (2013.01); *B41J 2/325* (2013.01); *B41J 3/36* (2013.01);
(Continued)

(58) Field of Classification Search
CPC ..... B41J 32/00; B41J 2/32; B41J 2/325; B41J 3/36; B41J 15/044; B41J 17/24; B41J 17/30; B41J 17/32
See application file for complete search history.

(56) References Cited

U.S. PATENT DOCUMENTS 5,429,443 A 7/1995 Kobayashi et al.
5,466,076 A 11/1995 Kobayashi et al.
(Continued)

FOREIGN PATENT DOCUMENTS

CN 1657306 A 8/2005
CN 1669807 A 9/2005
(Continued)

OTHER PUBLICATIONS

Feb. 28, 2019—(CN) Notification of First Office Action—App 201680031717.X.
(Continued)

*Primary Examiner* — Lamson D Nguyen
(74) *Attorney, Agent, or Firm* — Banner & Witcoff, Ltd.

(57) ABSTRACT

A ribbon cassette includes a case, an ink ribbon, a first spool, a second spool, a rotating member, a clutch spring, and an engaging part. The ink ribbon has one end portion wound over the first spool and another end portion connected to the second spool. The rotating member is engaged with a first inner surface of the first spool. The clutch spring includes a coil like annular part attached to the rotating member, and an extension part extending from the annular part. The engaging part is positioned on a locus of rotation of the extension
(Continued)

part. The first spool has a protrusion provided at a second inner surface of the first spool. The case-hole is in communication with an interior of the first spool, and has a portion overlapped with an entire circular region surrounded by a path of rotation of the tip end of the protrusion.

26 Claims, 19 Drawing Sheets

Related U.S. Application Data continuation of application No. PCT/JP2016/070667, filed on Jul. 13, 2016.

(51) Int. Cl.

| | |
|---|---|
| ***B41J 17/32*** | (2006.01) |
| ***B41J 2/325*** | (2006.01) |
| ***B41J 15/04*** | (2006.01) |
| ***B41J 17/24*** | (2006.01) |
| ***B41J 2/32*** | (2006.01) |
| ***B41J 3/36*** | (2006.01) |

(52) U.S. Cl.

CPC ..... *B41J 15/044* (2013.01); *B41J 17/24* (2013.01); *B41J 17/30* (2013.01); *B41J 17/32* (2013.01)

(56) References Cited

U.S. PATENT DOCUMENTS

| | | | | |
|---|---|---|---|---|
| 5,494,362 | A | 2/1996 | Kobayashi et al. | |
| 5,622,440 | A | 4/1997 | Yamamoto et al. | |
| 6,621,510 | B2 | 9/2003 | Hayashi | |
| 7,150,572 | B2 | 12/2006 | McNestry et al. | |
| 7,258,501 | B2 | 8/2007 | Yamamoto | |
| 10,166,800 | B2 * | 1/2019 | Tonishi | B41J 15/044 |
| 2001/0046399 | A1 | 11/2001 | Hayashi | |
| 2004/0146331 | A1 | 7/2004 | McNestry et al. | |
| 2010/0166480 | A1 | 7/2010 | Yamaguchi et al. | |
| 2012/0080550 | A1 | 4/2012 | Yamaguchi et al. | |

FOREIGN PATENT DOCUMENTS

| | | | |
|---|---|---|---|
| CN | 2885587 | Y | 4/2007 |
| CN | 101758672 | A | 6/2010 |
| EP | 1707395 | A1 | 10/2006 |
| EP | 2415610 | A1 | 2/2012 |
| JP | S59-134563 | U | 9/1984 |
| JP | S60-058361 | U | 4/1985 |
| JP | S61-005976 | A | 1/1986 |
| JP | H1-210373 | A | 8/1989 |
| JP | H06-048004 | A | 2/1994 |
| JP | H07-329385 | A | 12/1995 |
| JP | 2000-211225 | A | 8/2000 |
| JP | 2011-056755 | A | 3/2011 |
| JP | 2011-206915 | A | 10/2011 |

OTHER PUBLICATIONS

Mar. 15, 2019—(EP) Extended search report—App 16824487.9.
Oct. 4, 2016—International Search Report—Intl App PCT/JP2016/070667.
Oct. 4, 2016—(WO) Written Opinion—App PCT/JP2016/070667—Eng. Translation.
Jan. 25, 2018—(WO) IPRP—App PCT/JP2016/070667.
Sep. 11, 2019—(CN) Notification of the Second Office Action—App 201680031717.X.

* cited by examiner

RIBBON CASSETTE INCLUDING INK RIBBON, FIRST SPOOL, AND SECOND SPOOL

CROSS REFERENCE TO RELATED APPLICATION

This application is a continuation of U.S. patent application Ser. No. 15/718,232 filed Sep. 28, 2017, which is a by-pass continuation of International Application No. PCT/JP2016/070667 filed Jul. 13, 2016 claiming priorities from Japanese Patent Application No. 2015-139561 filed Jul. 13, 2015 and Japanese Patent Application No. 2015-139567 filed Jul. 13, 2015. The entire contents of the priority applications and the international application are incorporated herein by reference.

TECHNICAL FIELD

The present disclosure relates to a ribbon cassette storing therein an ink ribbon.

BACKGROUND

A cassette that accommodates an ink ribbon is well known in the art (see, for example, Japanese Patent Application Publication No. 2011-56755). A ribbon cassette described in the Publication '755 includes an ink ribbon wound about a ribbon spool. The ribbon spool is rotatably supported by an upper ribbon support part disposed in an upper case. A rotating member to which a clutch spring is mounted is disposed inside the ribbon spool. The rotating member restricts the ribbon spool from rotating in the direction opposite the direction for pulling ink ribbon off the ribbon spool by the elastic force (i.e., the rotational load) of the clutch spring.

SUMMARY

In the manufacturing process for the conventional tape cassette described above, it is desirable that workers can easily inspect the tape cassette upon completion to determine whether the clutch spring is properly mounted, without needing a special inspecting tool.

It is an object of the present disclosure to provide a ribbon cassette that enables a worker to easily inspect a unit ribbon cassette to determine whether the components that apply rotational load to the ribbon spool have been properly mounted, the inspection being performed on the basis of only a single ribbon cassette.

In order to attain the above and other objects, according to one aspect, the disclosure provides a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; a rotating member disposed in an interior of the first spool and engaged with a first inner surface which is a part of an inner surface of the first spool; a clutch spring including a coil like annular part attached to the rotating member, and an extension part extending from the annular part; and an engaging part provided in the case and positioned on a locus of rotation of the extension part. The first spool has a specific protruding portion provided at a second inner surface which is another part of the inner surface of the first spool and is positioned at a different position from a position of the first inner surface with respect to a first direction which is an extending direction of a rotation axis of the first spool, the specific protruding portion protruding in a second direction crossing the rotation axis of the first spool. The case has a case-hole positioned closer to the second inner surface than to the first inner surface, the case-hole having a portion overlapped in the first direction with an entire circular region surrounded by a path of rotation of a tip end portion in the second direction of the specific protruding portion, the case-hole being in communication with the interior of the first spool.

According to a second aspect of the disclosure, there is provided a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; a rotating member disposed in an interior of the first spool and engaged with a first inner surface which is a part of an inner surface of the first spool; a clutch spring including a coil like annular part attached to the rotating member, and an extension part extending from the annular part; and an engaging part provided in the case and positioned on a path of rotation of the extension part. The first spool has a specific protruding portion provided at a second inner surface which is another part of the inner surface of the first spool and is positioned at a different position from a position of the first inner surface with respect to a first direction which is an extending direction of a rotation axis of the first spool, the specific protruding portion protruding in a second direction crossing the rotation axis of the first spool. The case has a case-hole with which an end portion in the first direction of the first spool is fitted, the end portion of the first spool being closer to the second inner surface than to the first inner surface in the first direction.

According to a third aspect, there is provided a ribbon cassette including a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; and an elastic member in contact with at least one of the first spool and the case with elastically deforming state. The first spool has a specific protruding portion provided at an inner surface of the first spool, the specific protruding portion protruding in a second direction crossing a rotation axis of the first spool, the rotation axis extending in a first direction. The case has a case-hole having a portion overlapped with an entire circular region surrounded by a path of rotation of a tip end portion in the second direction of the specific protruding portion, the case-hole being in communication with the interior of the first spool.

According to a fourth aspect, there is a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; and an elastic member in contact with the first spool and the case with elastically deforming state. The first spool has a specific protruding portion provided at an inner surface of the first spool, the specific protruding portion protruding in a second direction crossing a rotation axis of the first spool, the rotation axis extending in a first direction. The case has a case hole with which the first spool is fitted.

BRIEF DESCRIPTION OF THE DRAWINGS

The particular features and advantages of the embodiment(s) as well as other objects will become apparent from the following description taken in connection with the accompanying drawings, in which:

FIG. 18A is the vertical cross-sectional view of a ribbon spool 251 according to the modification; FIG. 18B is the vertical cross-sectional view of a ribbon spool 252 according to the another modification; and FIG. 18C is the vertical cross-sectional view of a ribbon spool 253 according to the still another modification;

FIG. 19A is the explanatory view of a ribbon cassette 501 according to the modification; FIG. 19B is the explanatory view of a ribbon cassette 502 according to the another modification; and FIG. 19C is the explanatory view of a ribbon cassette 503 according to the still another modification;

FIG. 20A is the bottom view of an upper case 102 to which an elastic body 181 is provided; and FIG. 20B is the bottom view of the upper case 102 to which an elastic body 182 is provided.

DETAILED DESCRIPTION

An embodiment of the present disclosure will be described while referring to the accompanying drawings. In the following description, the lower-left, upper-right, upper-left, lower-right, top, and bottom in FIG. 1 will be respectively referred to as the front, rear, left, right, top, and bottom of a printing device 1. The upper-right, lower-left, lower-right, upper-left, top, and bottom in FIG. 7 will be respectively referred to as the front, rear, left, right, top, and bottom of a ribbon cassette 100.

1. Structure of Printing Device 1

Figure 1:
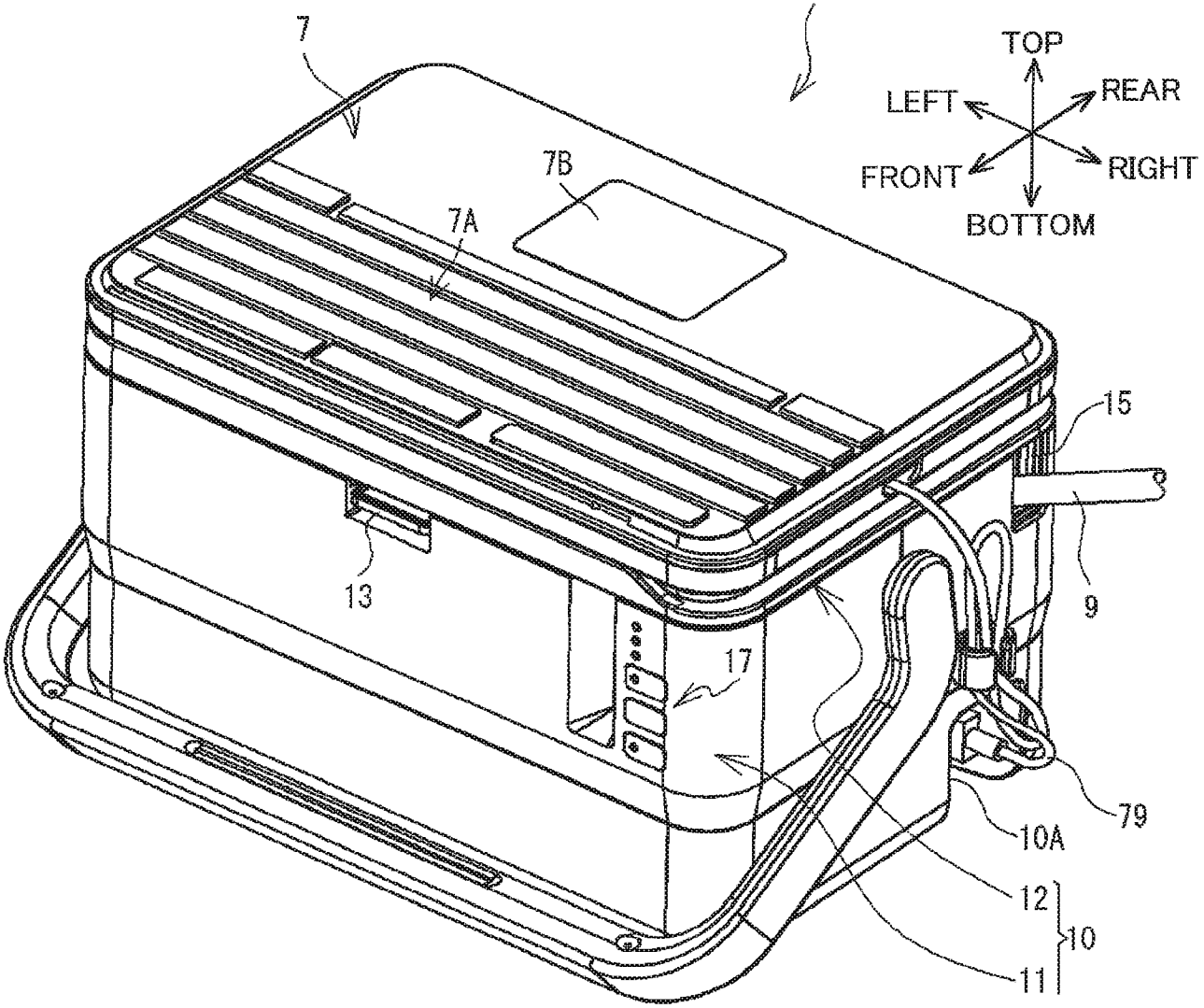
FIG. 1 is a perspective view of a printing device 1 as viewed from a right, front, and upper side of the printing device.

The printing device 1 will be described with reference to FIGS. 1 through 6. The printing device 1 prints on a tube 9, which is a tubular printing medium, while conveying the same, and cuts the tube 9 after printing. As illustrated in FIG. 1, the printing device 1 is provided with a housing 10 that includes a main body case 11, and a cover 12. The main body case 11 is a box-like member having a rectangular parallelepiped shape that is elongated in the left-right direction. The cover 12 is a plate-shaped member disposed on the upper side of the main body case 11. A rear end portion of the cover 12 is pivotally movably supported to the rear upper end portion of the main body case 11. A locking mechanism 13 is provided on the front upper end portion of the main body case 11. The locking mechanism 13 locks a front end portion of the cover 12 that is closed with respect to the main body case 11, and restricts opening of the cover 12.

Figure 2:
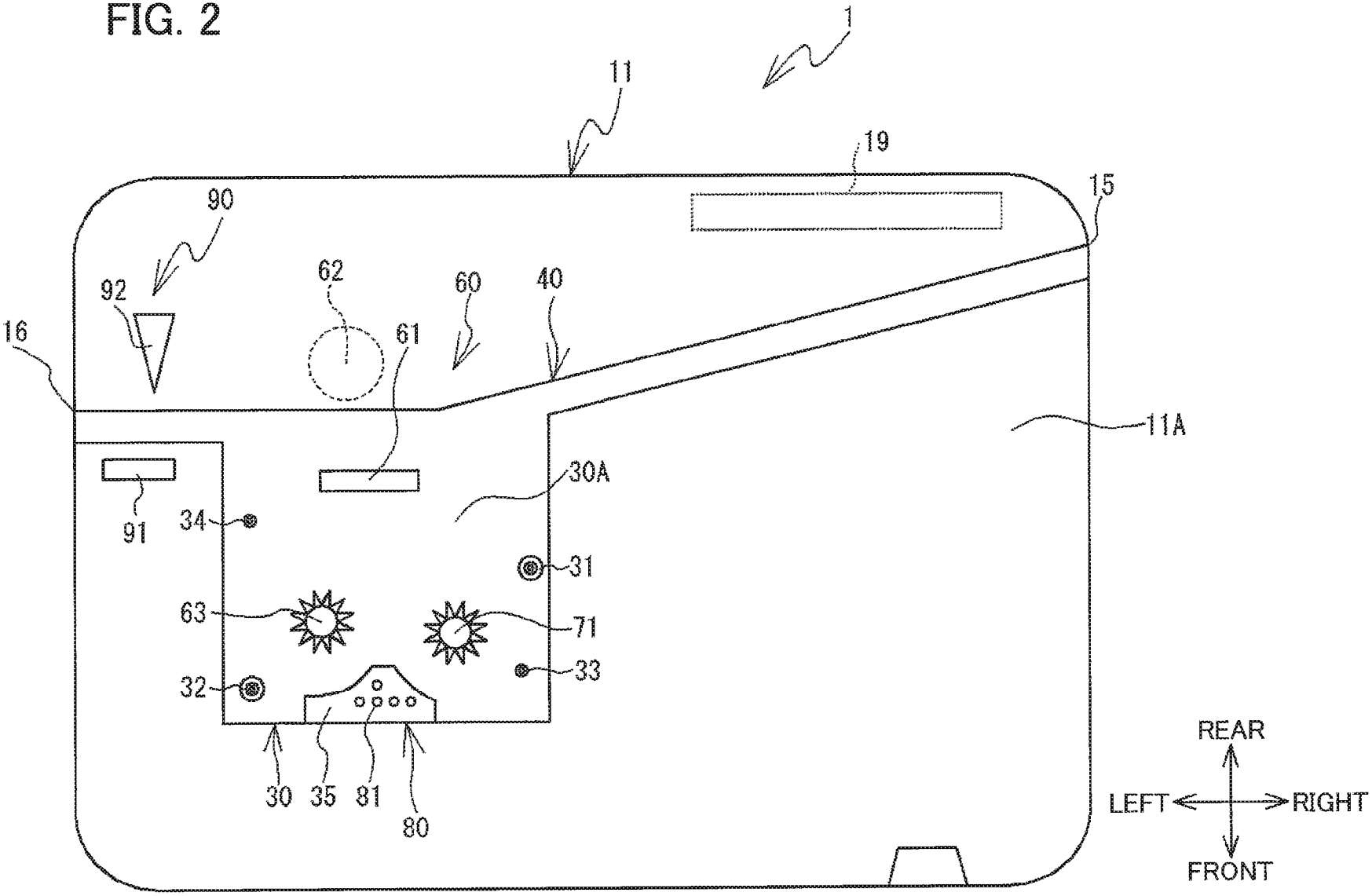
FIG. 2 is a plan view of a main body case 11.
Figure 3:
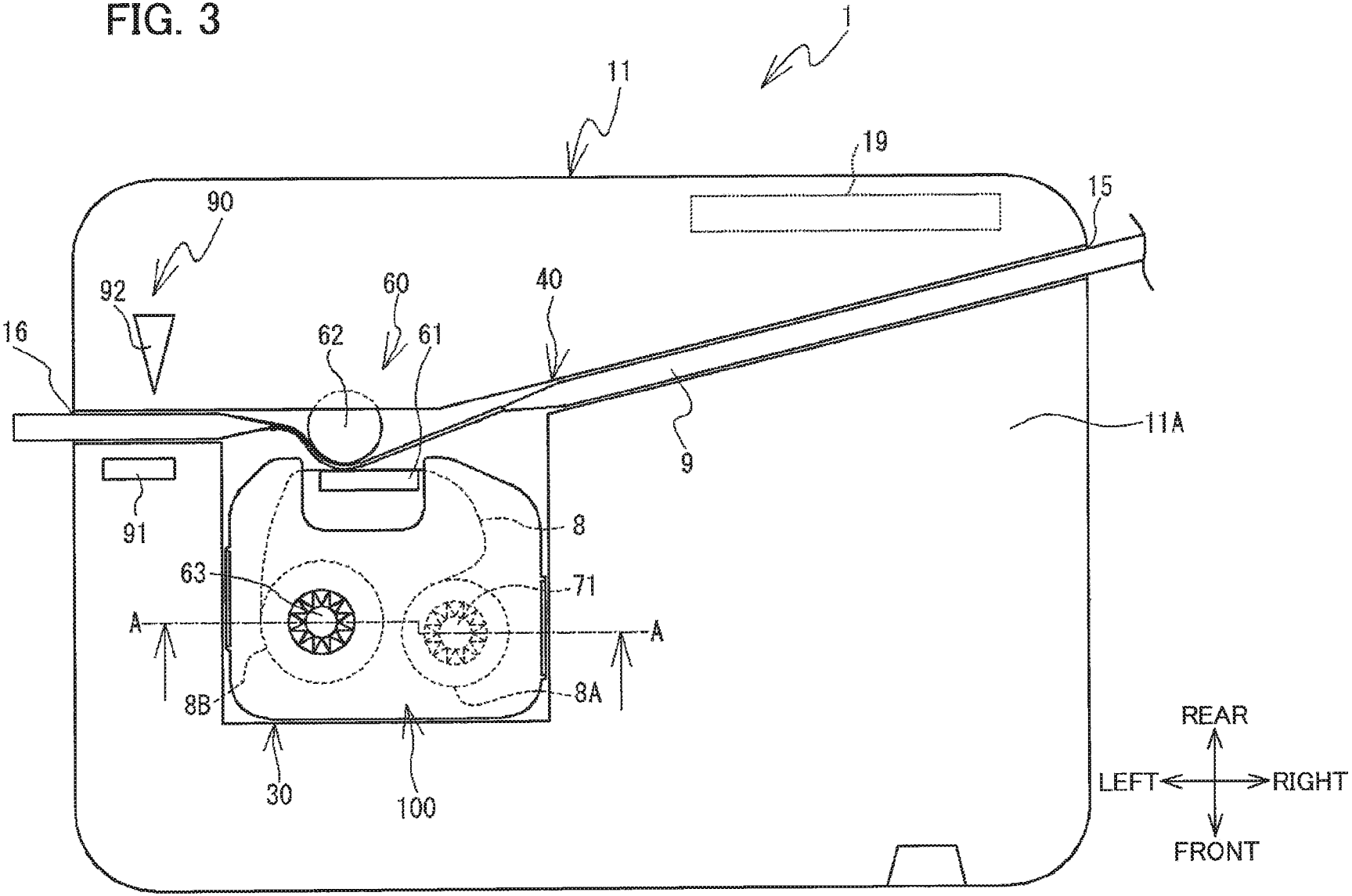
FIG. 3 is a plan view of the main body case 11 to which a tube 9 and a ribbon cassette 100 are mounted.

When the cover 12 is closed with respect to the main body case 11 (see FIG. 1), the cover 12 covers a mounting surface 11A (see FIG. 2). The mounting surface 11A is a top surface of the main body case 11. For opening the cover 12, the user operates the locking mechanism 13 to release the cover 12, allowing the cover 12 to pivotally move upward from the locking mechanism 13. When the cover 12 is opened with respect to the main body case 11, the mounting surface 11A is exposed to an outside.

A keyboard 7 is detachably mounted on the top surface of the cover 12. The keyboard 7 includes an operating section 7A having a plurality of keys, and a display section 7B that displays screens including various information. By operating the operating section 7A, the user can edit characters to be printed on the tube 9 within a screen displayed on the display section 7B. Characters include alphanumeric characters, symbols, graphics, and the like. A USB (Universal Serial Bus) cable 79 is connected to a built-in circuit board (not illustrated) in the keyboard 7. The USB cable 79 can be drawn out rightward from the right surface of the keyboard 7.

An operating section 17, a tube insertion opening 15, and a tube discharge opening 16 (see FIG. 2) are provided in side surfaces of the housing 10. The operating section 17 is configured of a plurality of operating buttons disposed on the front surface of the main body case 11 near the right side thereof. The operating buttons include a power button and a start button. The tube insertion opening 15 is an opening provided in the right side surface of the main body case 11 near the upper-rear corner thereof for guiding the tube 9 into the housing 10. The tube discharge opening 16 is an opening provided in the left side surface of the main body case 11 near the upper-rear corner thereof for discharging the tube 9 from the housing 10. The tube discharge opening 16 is positioned slightly forward of the tube insertion opening 15.

As illustrated in FIG. 2, a ribbon mounting section 30, a tube mounting section 40, and the like are provided in the mounting surface 11A. The ribbon mounting section 30 is the region in which the ribbon cassette 100 is detachably mounted. The ribbon mounting section 30 is a recessed part that is open on the top and whose opening is formed slightly larger than the ribbon cassette 100 in a plan view. The rear portion of the ribbon mounting section 30 is in communication with the tube mounting section 40 in the front-rear direction. The ribbon mounting section 30 of the present embodiment is provided in a left portion of the mounting surface 11A and on the front side of the tube mounting section 40. The user mounts the ribbon cassette 100 into the ribbon mounting section 30 from above so that the upward, downward, leftward, rightward, forward, and rearward directions of the ribbon cassette 100 are aligned with the upward, downward, leftward, rightward, forward, and rearward directions of the printing device 1.

Positioning pins 31 and 32, support pins 33 and 34, and a support part 35 are provided inside the ribbon mounting section 30. The positioning pins 31 and 32 and the support pins 33 and 34 are all columnar-shaped cylindrical shaft members that extend upward from a bottom surface 30A of the ribbon mounting section 30. The top ends of the positioning pins 31 and 32 and support pins 33 and 34 are all at the same vertical position (i.e., height). The positioning pins 31 and 32 have the same diameter. The support pins 33 and 34 have the same diameter, which is smaller than the diameter of the positioning pins 31 and 32.

The positioning pins 31 and 32 are disposed at positions corresponding to respective positioning holes 121 and 122 (see FIG. 9) formed in the ribbon cassette 100 that is mounted in the ribbon mounting section 30. The support pins 33 and 34 are disposed at positions corresponding to respective pin holes 123 and 124 (see FIG. 9) formed in the ribbon cassette 100 that is mounted in the ribbon mounting section 30. In the present embodiment, the positioning pin 31 and support pin 33 are respectively disposed on the right-rear side and right-front side of a rotatable detection shaft 71 described later and are aligned with each other in the approximate front-rear direction. The positioning pin 32 and support pin 34 are respectively disposed on the left-front side and left-rear side of a ribbon take-up shaft 63 described later and are aligned with each other in the approximate front-rear direction. The distance between the positioning pin 32 and support pin 34 in the front-rear direction is slightly greater than the distance between the positioning pin 31 and support pin 33 in the front-rear direction.

The support part 35 is a stepped part that protrudes upward from the bottom surface 30A. The top surface of the support part 35 has a vertical position (i.e., height) equivalent to the top ends of the positioning pins 31 and 32 and support pins 33 and 34. The support part 35 is disposed in a position corresponding to a front recessed part 125 (see FIG. 9) formed in the ribbon cassette 100 that is mounted in the ribbon mounting section 30. In the present embodiment, the support part 35 is disposed at a position aligned with a print head 61 in the front-rear direction and on a line connecting the positioning pin 32 and support pin 33. The top surface of the support part 35 is flat, with a shape corresponding to the front recessed part 125 in a plan view.

The tube mounting section 40 is the region in which the tube 9 is detachably mounted. The tube mounting section 40 is a groove part that is open on the top and that extends from the tube insertion opening 15 to near the right side of the tube discharge opening 16. Since the tube discharge opening 16 is slightly forward of the tube insertion opening 15, the tube mounting section 40 extends in a general left-right direction that slants slightly toward the left-front side. The direction in which the tube mounting section 40 extends from the tube insertion opening 15 toward the tube discharge opening 16 will referred to as a tube-feeding direction. The user mounts the tube 9 in the tube mounting section 40 in the tube-feeding direction such that the tube 9 extends from the tube insertion opening 15 to the tube discharge opening 16.

A control board 19, a printing mechanism 60, a conveyance amount detecting unit 70, an indicator detection unit 80, and a cutting mechanism 90 will be described with reference to FIGS. 2 through 5. The control board 19 is a circuit board that controls operations of the printing device 1. As illustrated in FIG. 2, the control board 19 is disposed in the right-rear section on the inside of the main body case 11 and is connected to a USB connector 18 (see FIG. 6). The USB connector 18 is exposed to the outside of the main body case 11 from a plug accommodating section 10A (see FIG. 1) formed in a bottom part on the right surface of the housing 10 (see FIG. 1). The USB cable 79 (see FIG. 1) led out from the keyboard 7 is connected to the USB connector 18 through the plug accommodating section 10A.

Figure 6:
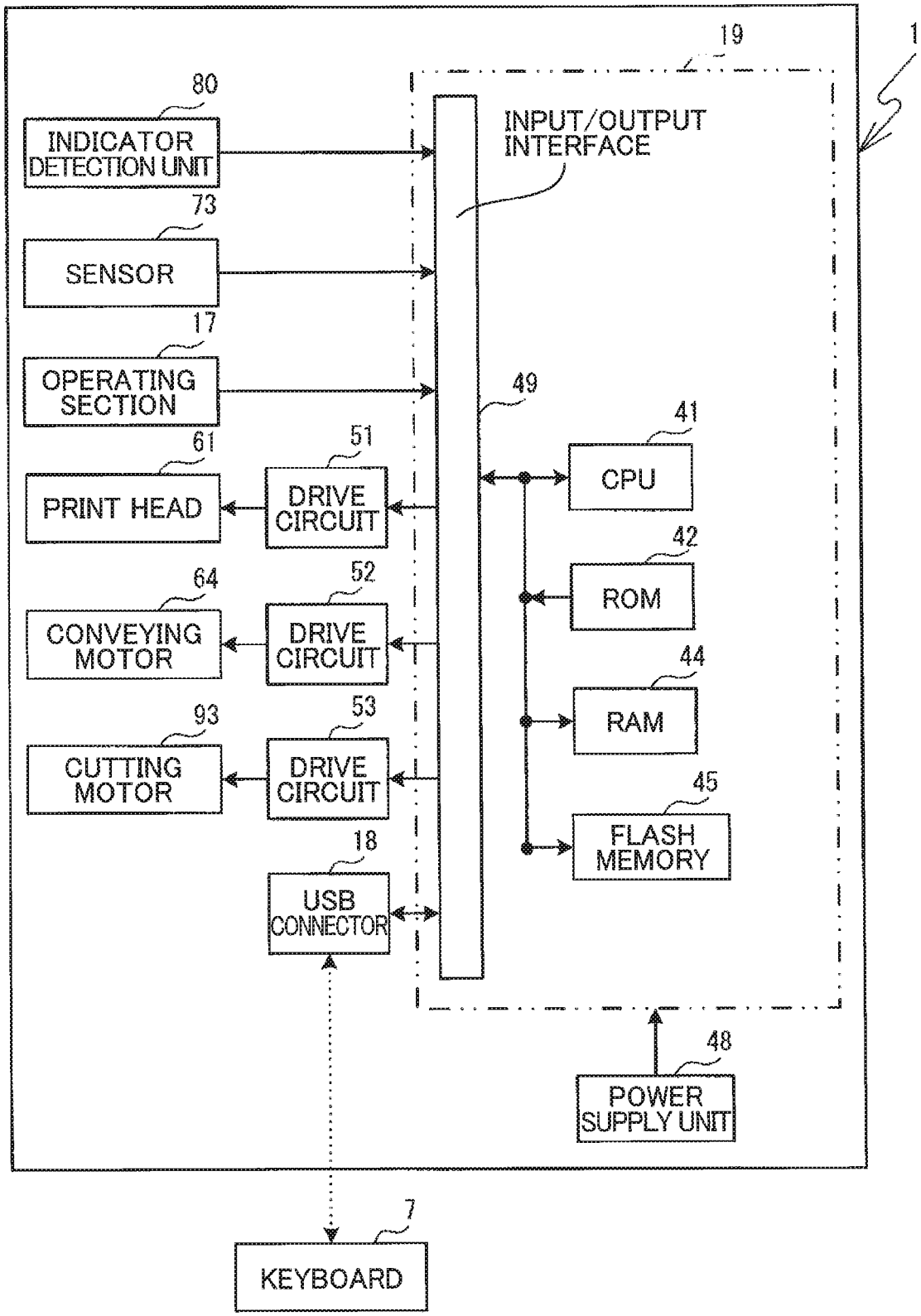
FIG. 6 is a block diagram illustrating an electric structure in the printing device 1.

The printing mechanism 60 includes a print head 61, a moveable conveying roller 62, the ribbon take-up shaft 63, and a conveying motor 64 (see FIG. 6). The print head 61 and ribbon take-up shaft 63 upstand from the bottom surface 30A. The print head 61 and ribbon take-up shaft 63 extend higher upward than the positioning pins 31 and 32, support pins 33 and 34, and support part 35.

The print head 61 is a thermal head that includes a heater (not illustrated). The print head 61 is disposed in a position that corresponds to a head insertion section 109 (see FIG. 7) formed in the ribbon cassette 100 that is mounted in the ribbon mounting section 30. In the present embodiment, the print head 61 is disposed in the approximate center of the rear portion of the ribbon mounting section 30.

The ribbon take-up shaft 63 is rotatable together with a take-up spool 300 (see FIG. 4) described later. A plurality of protruding pieces 63A (see FIG. 4) is provided on the outer circumferential surface of the ribbon take-up shaft 63. The protruding pieces 63A are arranged radially and at regular intervals about the axis of the ribbon take-up shaft 63. Each protruding piece 63A protrudes outward in a radial direction from an outer circumferential surface of the ribbon take-up shaft 63 and extends downward from near the top end of the ribbon take-up shaft 63. The ribbon take-up shaft 63 is disposed in a position corresponding to a first support hole 111 (see FIG. 7) formed in the ribbon cassette 100 that is mounted in the ribbon mounting section 30. In the present embodiment, the ribbon take-up shaft 63 is provided in the left portion of the ribbon mounting section 30, forward from the support pin 34 and rearward from the positioning pin 32.

The moveable conveying roller 62 is rotatable relative to the print head 61. The moveable conveying roller 62 is disposed on the rear side of the ribbon mounting section 30 and is displaceable between a retracted position and an operating position in association with the opening and closing of the cover 12 (see FIG. 1). When in the retracted position, the moveable conveying roller 62 is disposed on the rear side of the tube mounting section 40 and is separated from the print head 61 (see FIG. 2). When the moveable conveying roller 62 is in the operating position, a portion of the moveable conveying roller 62 is disposed inside the tube mounting section 40 and is adjacent to the print head 61 (see FIG. 3).

Figure 4:
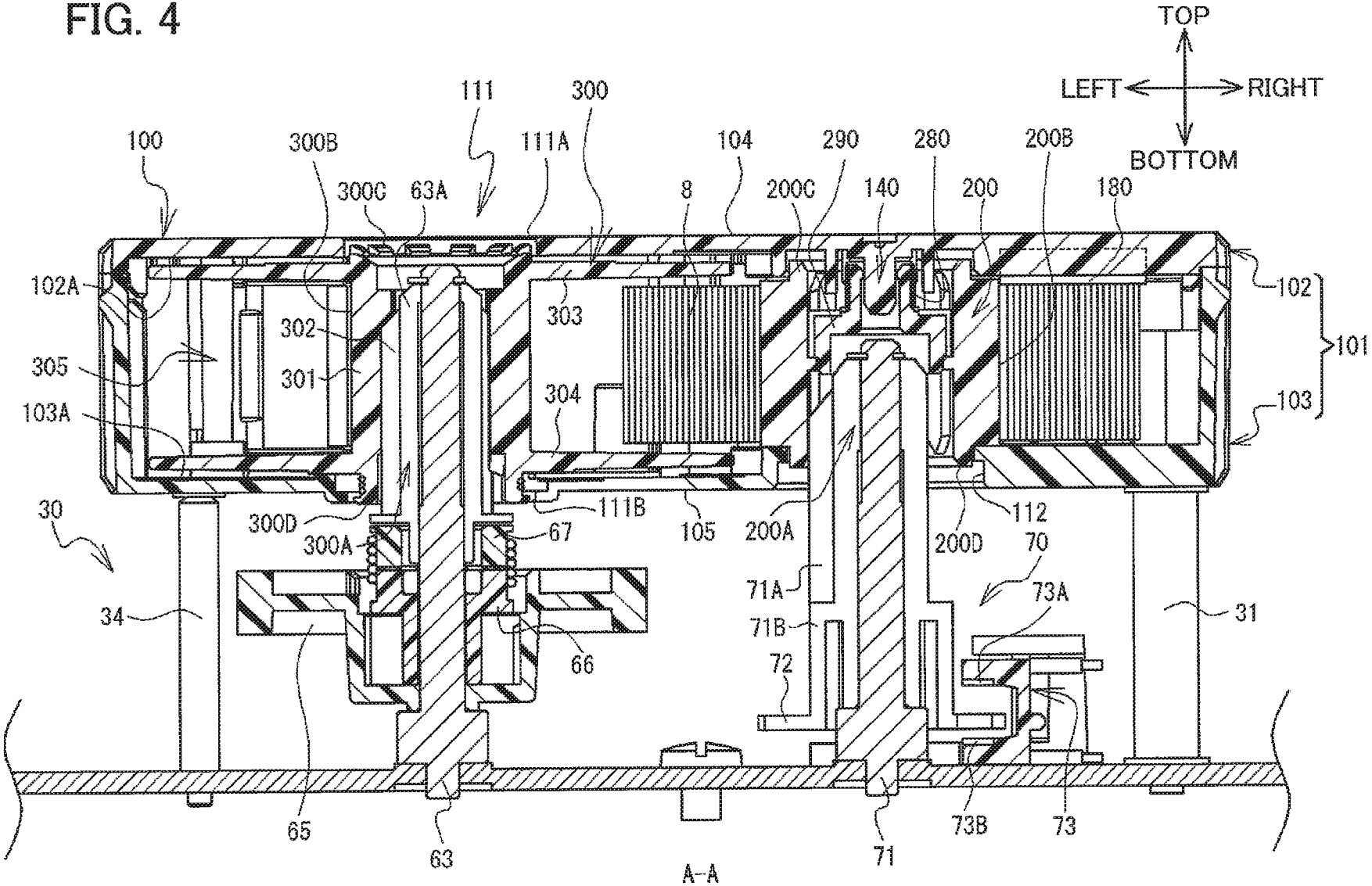
FIG. 4 is a cross-sectional view taken along a line A-A of FIG. 3.

The conveying motor 64 drives the moveable conveying roller 62 and ribbon take-up shaft 63 to rotate. As illustrated in FIG. 4, a disc-shaped gear 65 that is rotatable about the ribbon take-up shaft 63 is provided near the bottom end of the ribbon take-up shaft 63. The gear 65 is coupled to a fixed member 67 via a one-way clutch 66. The fixed member 67 is fixed at a position around the ribbon take-up shaft 63. Through the elastic force of a clutch spring, the one-way clutch 66 allows the ribbon take-up shaft 63 to rotate stably in a prescribed take-up direction (the counterclockwise direction in a plan view in the present embodiment), while restricting the ribbon take-up shaft 63 from rotating in the direction opposite the prescribed take-up direction.

By rotating the gear 65 in the counterclockwise direction in a plan view, the conveying motor 64 rotates the ribbon take-up shaft 63 in the take-up direction via the one-way clutch 66 and fixed member 67. When the conveying motor 64 rotates the gear 65, the moveable conveying roller 62 (see FIG. 2) rotates in the counterclockwise direction in a plan view along with the rotation of the gear 65 through a gear train (not illustrated) coupled to the gear 65. In this way, the moveable conveying roller 62 and ribbon take-up shaft 63 rotate in synchronism with each other.

As illustrated in FIG. 4, the conveyance amount detecting unit 70 is a member provided for detecting the conveyance amount of an ink ribbon 8 during a printing operation. The conveyance amount detecting unit 70 includes a rotatable detection shaft 71, a detection plate 72, and a sensor 73. The rotatable detection shaft 71 upstands from the bottom surface 30A (see FIG. 2). The rotatable detection shaft 71 extends farther upward than the positioning pins 31 and 32, support pins 33 and 34, and support part 35. The top end of the rotatable detection shaft 71 is lower than the top ends of the print head 61 and ribbon take-up shaft 63. The rotatable detection shaft 71 is rotatable together with a ribbon spool 200 described later.

As illustrated in FIG. 2, the rotatable detection shaft 71 is disposed in a position corresponding to a second support hole 112 (see FIG. 9) formed in the ribbon cassette 100 that is mounted in the ribbon mounting section 30. In the present embodiment, the rotatable detection shaft 71 is disposed in the rear portion of the ribbon mounting section 30, forward of the positioning pin 31 and rearward of the support pin 33. The axis of the rotatable detection shaft 71 is slightly forward from the axis of the ribbon take-up shaft 63.

Figure 5:
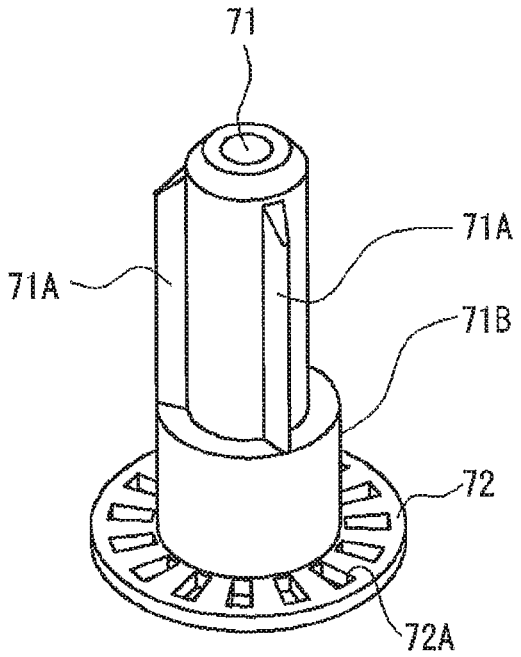
FIG. 5 is a perspective view of a rotatable detection shaft 71.

As illustrated in FIGS. 4 and 5, the rotatable detection shaft 71 has a plurality of protruding pieces 71A, a cylindrical part 71B, and the detection plate 72. The cylindrical part 71B is a hollow cylindrical member provided around the rotatable detection shaft 71 and is rotatable together with the rotatable detection shaft 71. The plurality of protruding pieces 71A are disposed on the circumferential surface of the cylindrical part 71B and are arranged radially and at regular intervals about the axis of the rotatable detection shaft 71. Each protruding piece 71A protrudes radially outward from the outer circumferential surface of the cylindrical part 71B and extends downward from near the top end of the cylindrical part 71B.

The detection plate 72 is disc-shaped and protrudes radially outward from near the bottom end of the cylindrical part 71B. The center of the detection plate 72 in a plan view is aligned with the axis of the rotatable detection shaft 71. As illustrated in FIG. 5, a plurality of detection holes 72A is formed in the detection plate 72. The detection holes 72A penetrate the detection plate 72 vertically and are arranged radially and at regular intervals about the center of the detection plate 72 in a plan view.

As illustrated in FIG. 4, the sensor 73 is a transmissive photo-sensor having a light-emitting unit 73A and a light-receiving unit 73B. The light-emitting unit 73A and light-receiving unit 73B are arranged so as to confront each other in the vertical direction interposing the detection plate 72 therebetween. During a printing operation, a CPU 41 (see FIG. 6) controls the light-emitting unit 73A to irradiate light toward the light-receiving unit 73B. The light-receiving unit 73B receives light irradiated from the light-emitting unit 73A when the light passes through any of the detection holes 72A. At such times, the sensor 73 outputs an ON signal to the CPU 41. However, the light-receiving unit 73B does not receive light irradiated from the light-emitting unit 73A when the light is reflected by the detection plate 72. At such times, the sensor 73 outputs an OFF signal to the CPU 41. Note that the sensor 73 may instead be a reflective photo-sensor that can detect light reflected off the detection plate 72.

As illustrated in FIG. 2, the indicator detection unit 80 is a member provided for detecting a type indicating part 190 (see FIG. 9) of the ribbon cassette 100. The indicator detection unit 80 has five detection switches 81 provided on a circuit board not illustrated in the drawings. The detection switches 81 are mechanical switches that can advance and retract vertically. The five detection switches 81 are movable vertically inside holes formed in the top surface of the support part 35. The five detection switches 81 are disposed in positions corresponding to indicators 191-195 (see FIG. 9) provided on the ribbon cassette 100 that is mounted in the ribbon mounting section 30. In the present embodiment, four detection switches 81 are arrayed in a row in the left-right direction. The remaining detection switch 81 is positioned on the rear side of the second detection switches 81 from the left among these four detection switches 81.

Each detection switches 81 is urged upward by a spring not illustrated in the drawings. Detection switches 81 to which an external force is not applied are moved upward from the support part 35 by the urging force of the springs not illustrated in the drawings to a reference position. The indicator detection unit 80 outputs an OFF signal for detection switches 81 in the reference position to the CPU 41 described later (see FIG. 6). On the other hand, when a detection switch 81 is pressed downward, the detection switch 81 moves to a depressed position, which is lower than the reference position. The indicator detection unit 80 outputs an ON signal for detection switches 81 in the depressed position to the CPU 41. The combination of ON signals and OFF signals for the five detection switches 81 will be referred to as a type detection pattern.

The cutting mechanism 90 executes operations for cutting the tube 9. As illustrated in FIG. 2, the cutting mechanism 90 is provided in the main body case 11 near the left end of the tube mounting section 40. That is, the cutting mechanism 90 is on the downstream side of the print head 61 in a tube-feeding direction. The cutting mechanism 90 includes a receiving plate 91, a cutting blade 92, and a cutting motor 93 (see FIG. 6). The receiving plate 91 has a rectangular parallelepiped shape and is disposed on the front side of the left end of the tube mounting section 40. The cutting blade 92 opposes the receiving plate 91 from the rear side of the tube mounting section 40. The cutting motor 93 moves the cutting blade 92 in the front-rear direction so that the cutting blade 92 moves toward and away from the receiving plate 91.

The electrical structure of the printing device 1 will be described with reference to FIG. 6. The control board 19 is provided with the CPU 41, a ROM 42, a RAM 44, a flash memory 45, an input/output interface 49, and the like, which components are interconnected via a data bus. The ROM 42 stores programs enabling the CPU 41 to implement various control including a printing operation. The RAM 44 temporarily stores various data. The flash memory 45 stores a table defining ribbon types corresponding to type detection patterns. For example, the ribbon type indicates the color and width of the ink ribbon 8 accommodated in the ribbon cassette 100.

The printing device 1 has a power supply unit 48. The power supply unit 48 is connected to a battery (not illustrated) mounted in the main body case 11 or an external power supply (not illustrated) via a cord, and supplies power to the control board 19. The operating section 17, the USB connector 18, drive circuits 51-53, the sensor 73, and the indicator detection unit 80 are all connected to the input/output interface 49. The USB connector 18 is connected to the keyboard 7 via the USB cable 79 (see FIG. 1). The CPU 41 receives various information inputted via the operating section 17. The CPU 41 receives various commands inputted via the operating section 7A (see FIG. 1) and controls the display of screens on the display section 7B. The CPU 41 receives ON/OFF signals outputted from the sensor 73 and type detection patterns outputted from the indicator detection unit 80.

The drive circuits 51-53 are connected to the print head 61, conveying motor 64, and cutting motor 93, respectively. The CPU 41 controls the drive of the print head 61 by transmitting control signals to the drive circuit 51. The CPU 41 controls the drive of the conveying motor 64 by transmitting pulse signals to the drive circuit 52. The CPU 41 controls the drive of the cutting motor 93 by transmitting control signals to the drive circuit 53.

2. Structure of Ribbon Cassette 100

The ribbon cassette 100 will be described with reference to FIGS. 7 through 11. FIGS. 7 through 10 illustrate the ribbon cassette 100 in an initial state in which the ribbon cassette 100 has not yet been used in a printing operation. In the initial state, the ribbon cassette 100 has an entirely unused ink ribbon 8. A predetermined upper limit quantity (maximum amount) of the ink ribbon 8 is wound around the ribbon spool 200. The ink ribbon 8 is not wound around the take-up spool 300 (the same is the case in FIG. 4 described above).

Figure 7:
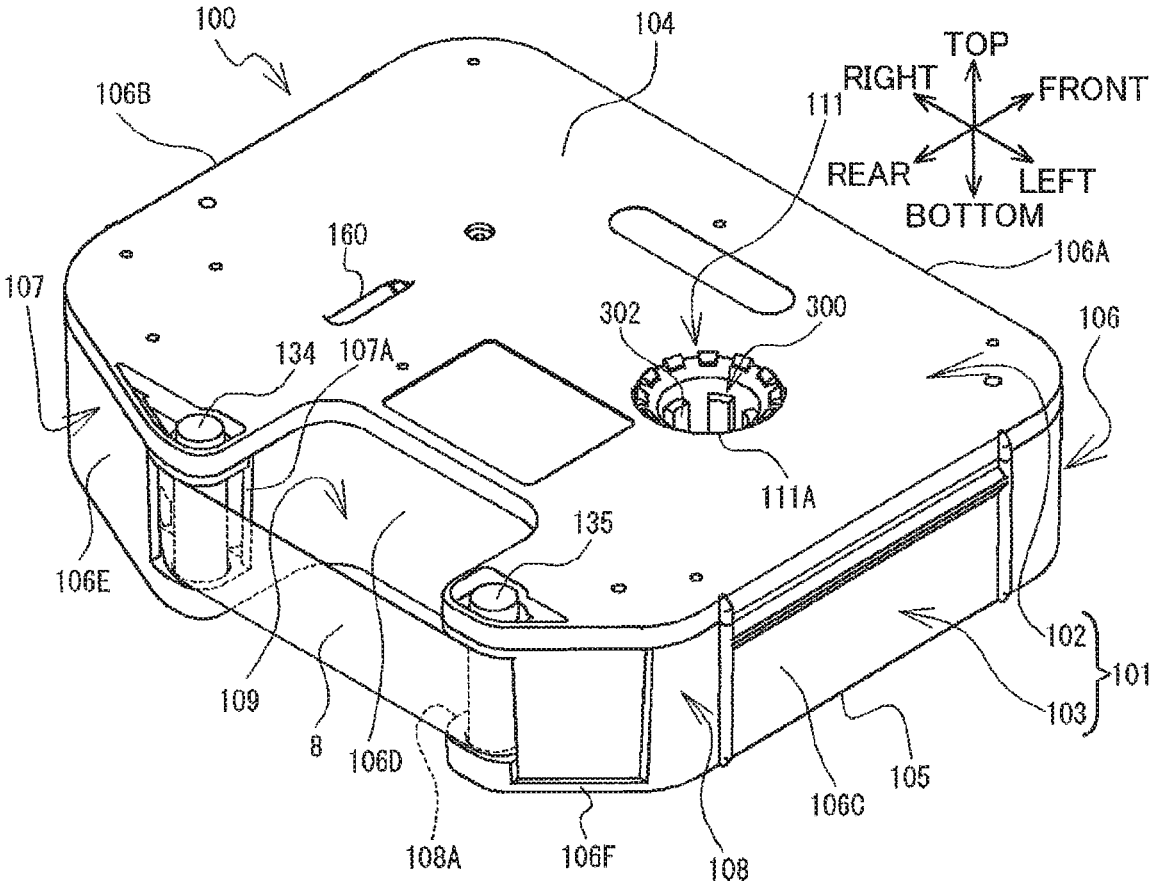
FIG. 7 is a perspective view of the ribbon cassette 100 as viewed from a left, rear, and upper side of the ribbon cassette.
Figure 8:
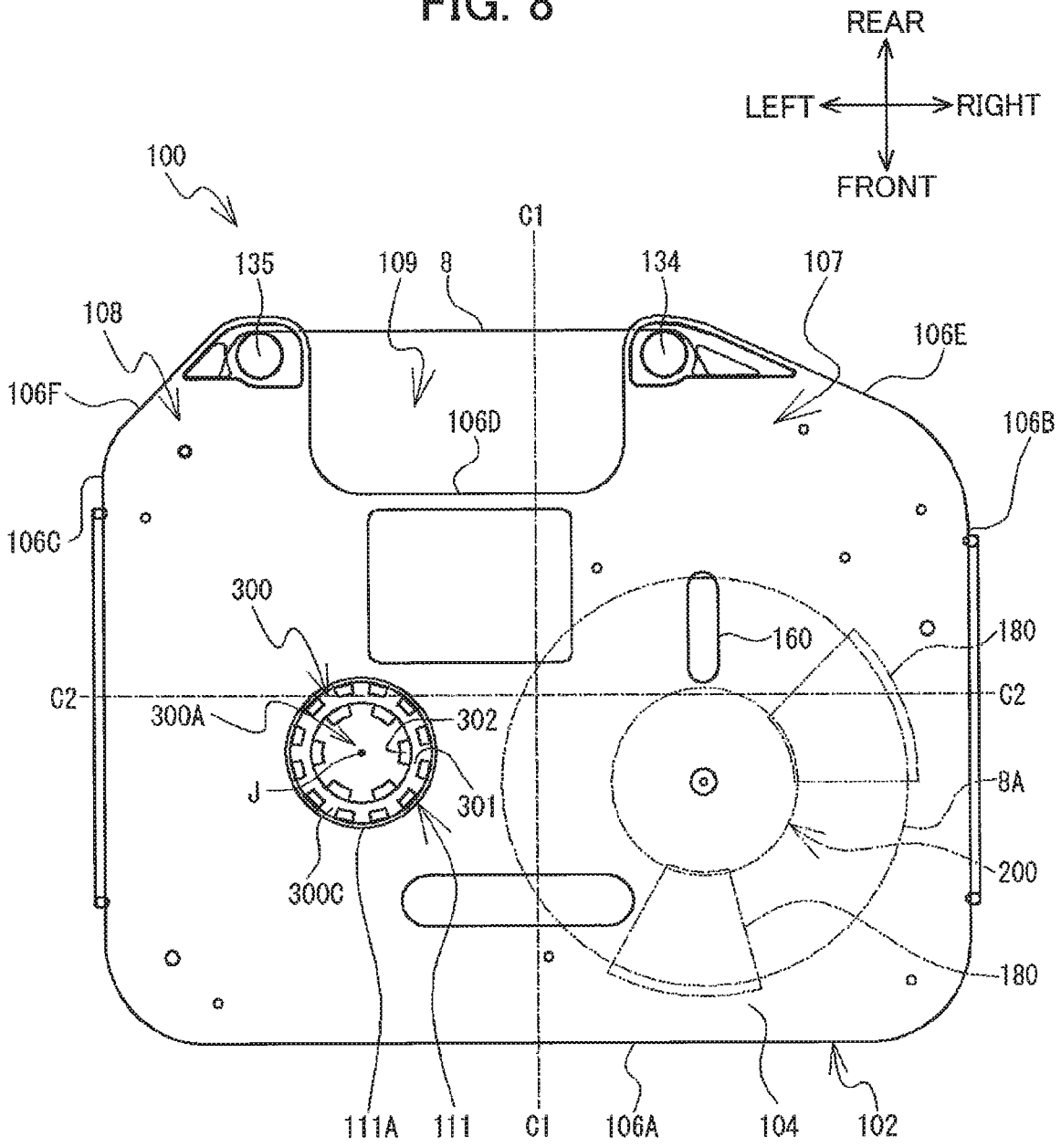
FIG. 8 is a plan view of the ribbon cassette 100.
Figure 9:
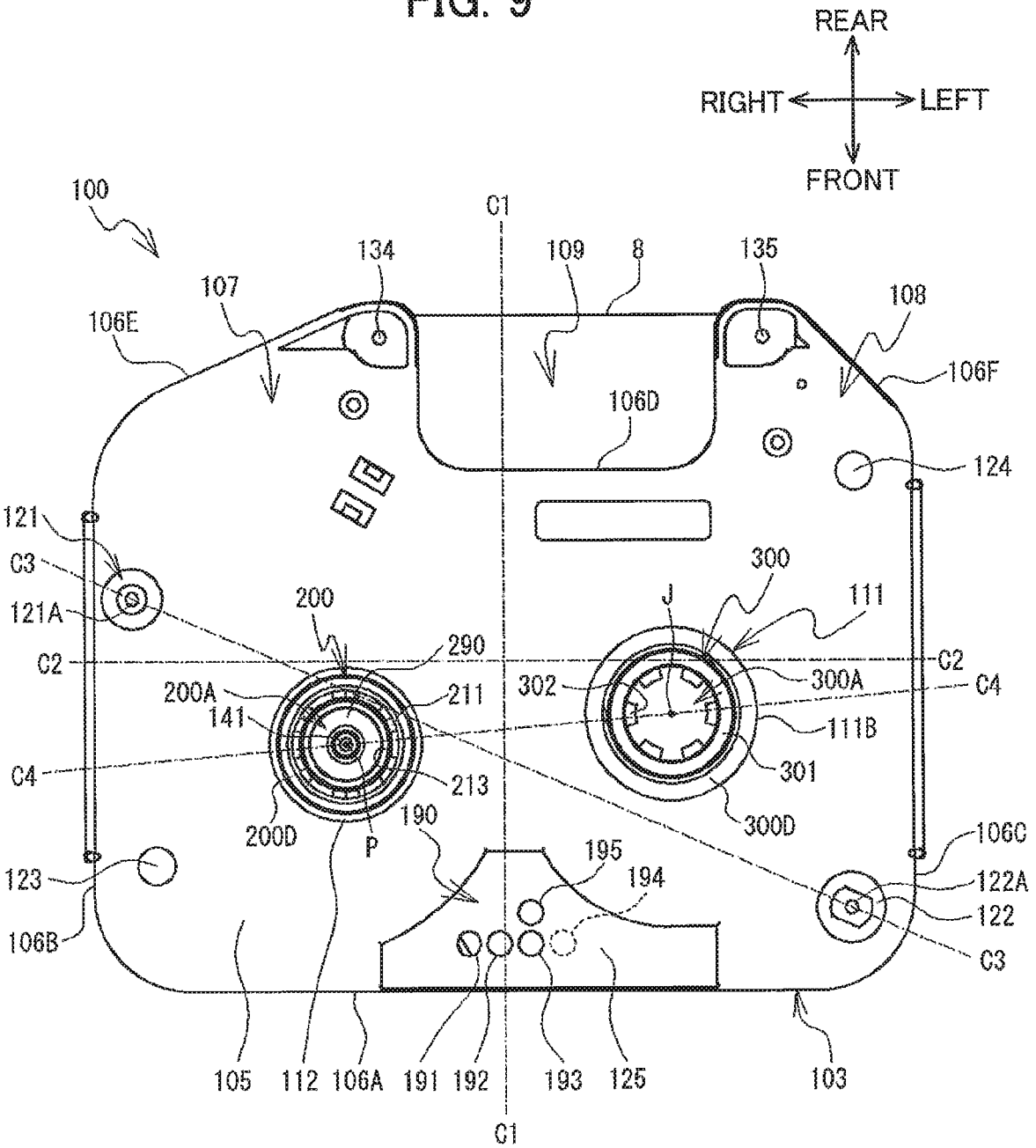
FIG. 9 is a bottom view of the ribbon cassette 100.

As illustrated in FIGS. 7 through 9, the ribbon cassette 100 has a case 101 that accommodates the ink ribbon 8. The case 101 has a box shape that is long in the left-right direction and short in the vertical direction. The case 101 includes a lower case 103, and an upper case 102 that assembles to the top of the lower case 103. The top surface of the upper case 102 and the bottom surface of the lower case 103 respectively constitute a top surface 104 and a bottom surface 105 of the case 101. The top surface 104 and bottom surface 105 oppose each other vertically and have the same approximate shape in a plan view. An imaginary line extending in the front-rear direction through the left-right center of the case 101 is a centerline C1 (see FIGS. 8 through 11). An imaginary line extending in the left-right direction through the front-rear center of the case 101 is a centerline C2 (see FIGS. 8 through 11).

A side surface 106 of the case 101 extends vertically between the top surface 104 and bottom surface 105 and extends along the outer edges of the top surface 104 and bottom surface 105. The side surface 106 includes a front surface 106A, a right surface 106B, a left surface 106C, a head peripheral surface 106D, and connecting surfaces 106E and 106F. The front surface 106A extends in the left-right direction. The right surface 106B and left surface 106C extend rearward and parallel to each other from the respective right edge and left edge of the front surface 106A. The right surface 106B and left surface 106C are aligned with each other in the left-right direction and are substantially equivalent in length in the front-rear direction.

The head peripheral surface 106D is the part of the side surface 106 provided across the centerline C1 in a plan view and recessed forward from the rear edge of the case 101. The connecting surface 106E extends in a direction toward the right-front from the right-rear edge of the head peripheral surface 106D and is connected to the rear edge of the right surface 106B. The connecting surface 106F extends in a direction toward the left-front from the left-rear edge of the head peripheral surface 106D and is connected to the rear edge of the left surface 106C. The length of the connecting surface 106E in its extended direction is greater than the length of the connecting surface 106F in its extended direction.

The head insertion section 109 provides an inner region surrounded by the head peripheral surface 106D. The head insertion section 109 penetrates the case 101 vertically and is open toward the rear of the case 101. The head insertion section 109 has a generally rectangular shape that is elongated in the left-right direction in a plan view, and extends across the centerline C1 in the left-right direction. The left-right center of the head insertion section 109 is slightly leftward of the centerline C1.

The portion of the case 101 on the right side of the head insertion section 109 constitutes a first guide part 107. The first guide part 107 has a triangular shape in a plan view and is enclosed by the right surface of the head peripheral surface 106D and the connecting surface 106E. A ribbon outlet 107A is provided in the left-rear edge of the first guide part 107. The ribbon outlet 107A is an opening in communication with the head insertion section 109. The portion of the case 101 on the left side of the head insertion section 109 constitutes a second guide part 108. The second guide part 108 has a triangular shape in a plan view and is enclosed by the left surface of the head peripheral surface 106D and the connecting surface 106F. A ribbon inlet 108A is provided in the right-rear edge of the second guide part 108. The ribbon inlet 108A is an opening in communication with the head insertion section 109.

The case 101 has the first support hole 111 rotatably supporting the take-up spool 300 and the second support hole 112 rotatably supporting the ribbon spool 200 (see FIG. 9). The first support hole 111 is disposed in the left portion of the case 101 and positioned forward of the second guide part 108 and rearward of the front recessed part 125 described later. The first support hole 111 includes an upper hole 111A (see FIG. 8) and a lower hole 111B (see FIG. 9). The upper hole 111A is a circular hole that penetrates the upper case 102 vertically. The lower hole 111B is a circular hole that penetrates the lower case 103 vertically. The upper hole 111A and lower hole 111B have the same diameter and are aligned vertically. The rotational axis passing through the rotational center of the take-up spool 300 that is supported in the first support hole 111 will be referred to as an axis J.

As illustrated in FIG. 9, the second support hole 112 is disposed in the right portion of the case 101, farther forward than the first guide part 107 and rearward than the front recessed part 125. The second support hole 112 is a circular opening that penetrates the lower case 103 vertically. The rotational axis passing through the rotational center of the ribbon spool 200 that is supported in the second support hole 112 will be referred to as an axis P. Both axes P and J are forward of the centerline C2. The axis P is farther forward than the axis J.

The positioning holes 121 and 122, the pin holes 123 and 124, and the front recessed part 125 are provided in the lower case 103. The positioning holes 121 and 122 and the pin holes 123 and 124 are all recessed parts that are recessed upward from the bottom surface 105. The upper ends of the positioning holes 121 and 122 and the pin holes 123 and 124 are positioned at a reference height, which is a predetermined vertical position in the case 101. The reference height is a prescribed distance below the vertical center of the case 101. The prescribed distance is a constant that is independent of the vertical dimension of the case 101 (i.e., the thickness of the case 101).

In the present embodiment, the positioning hole 121 and pin hole 123 are respectively provided on the right-rear side and right-front side of the second support hole 112 and are substantially aligned in the front-rear direction. The positioning hole 121 and pin hole 123 are both near the right surface 106B. The positioning hole 122 and pin hole 124 are respectively provided on the left-front side and left-rear side of the lower hole 111B and are substantially aligned in the front-rear direction. The positioning hole 122 and pin hole 124 are both near the left surface 106C. The positioning hole 122 and pin hole 123 are positioned forward of the centerline C2, while the positioning hole 121 and pin hole 124 are positioned rearward of the centerline C2. The distance in the front-rear direction between the positioning hole 122 and pin hole 124 is greater than the distance in the front-rear direction between the positioning hole 121 and pin hole 123.

The bottom portion of the positioning hole 121 has a circular-shaped opening. The width of the opening at the bottom portion of the positioning hole 121 is slightly larger than the diameter of the positioning pin 31 (see FIG. 2). The top portion of the positioning hole 121 is an anchoring part 121A. The anchoring part 121A has a rounded hole that is closed by a top surface (not illustrated) at the reference height and is open to the bottom. The width of the opening at the anchoring part 121A is smaller than the diameter of the bottom portion of the positioning hole 121 and equivalent to the diameter of the positioning pin 31.

The bottom portion of the positioning hole 122 has a circular-shaped opening similar to the bottom portion of the positioning hole 121. The width of the opening at the bottom portion of the positioning hole 122 is slightly larger than the diameter of the positioning pin 32 (see FIG. 2). The upper portion of the positioning hole 122 is an anchoring part 122A. The anchoring part 122A is a hole that is closed by a top surface (not illustrated) at the reference height and that is open to the bottom. The anchoring part 122A is an elongate hole that extends in a direction from the right-rear to the left-front. The minimum opening width of the anchoring part 122A (i.e., the length of the anchoring part 122A in the transverse direction) is equivalent to the diameter of the positioning pin 32. The anchoring part 121A is positioned at an extension of a straight line following the longitudinal direction of the anchoring part 122A. An imaginary line connecting the centers of the anchoring parts 121A and 122A is a connecting line C3. The connecting line C3 extends substantially parallel to the longitudinal direction of the anchoring part 122A. The axis J is on the left side of the connecting line C3, and the axis P is on the right side of the connecting line C3.

The pin holes 123 and 124 are round holes that are closed on the top ends by top surfaces (not illustrated) positioned at the reference height. The openings of the pin holes 123 and 124 have the same diameter, which is slightly larger than the diameters of the support pins 33 and 34 and smaller than the diameters of openings formed in the bottom ends of the positioning holes 121 and 122.

The front recessed part 125 is a stepped part that is recessed upward from the bottom surface 105. The top surface of the front recessed part 125 is positioned at the reference height. The front recessed part 125 is in a position aligned with the head insertion section 109 in the front-rear direction and overlaps the line connecting the positioning hole 122 and pin hole 123. Specifically, the front recessed part 125 is disposed on the front end of the lower case 103 and extends across the centerline C1 in the left-right direction. The left edge of the front recessed part 125 is at a position in the left-right direction approximately equal to the left edge of the head insertion section 109. The right edge of the front recessed part 125 is slightly rightward of the right edge of the head insertion section 109 with respect to the left-right direction. The left-right center of the front recessed part 125 is slightly leftward of the centerline C1. The front recessed part 125 extends rearward along the centerline C1 in a bottom view. The rear edge of the front recessed part 125 is at the same approximate position as the pin hole 123 in the front-rear direction.

The type indicating part 190 indicating the ribbon type is provided in the top surface of the front recessed part 125. An imaginary line passing through the axis J and axis P is a connecting line C4. The type indicating part 190 is on the front side of the connecting line C4 and aligned with the head peripheral surface 106D in the front-rear direction. The type indicating part 190 in the present embodiment includes the indicators 191-195. The indicators 191-194 are arranged along the front surface 106A in the left-right direction. The indicator 195 is disposed on the rear side of the indicator 193, which is the second indicator from the left among the indicators 191-194. Each of the indicators 191-195 is configured of either a surface part or a hole part in a pattern corresponding to the ribbon type of the ribbon cassette 100. In the present embodiment, the indicators 191-193 and 195 are hole parts, while the indicator 194 is a surface part. The indicators 191-193 and 195 configured of hole parts are through-holes that penetrate the lower case 103 vertically.

Figure 10:
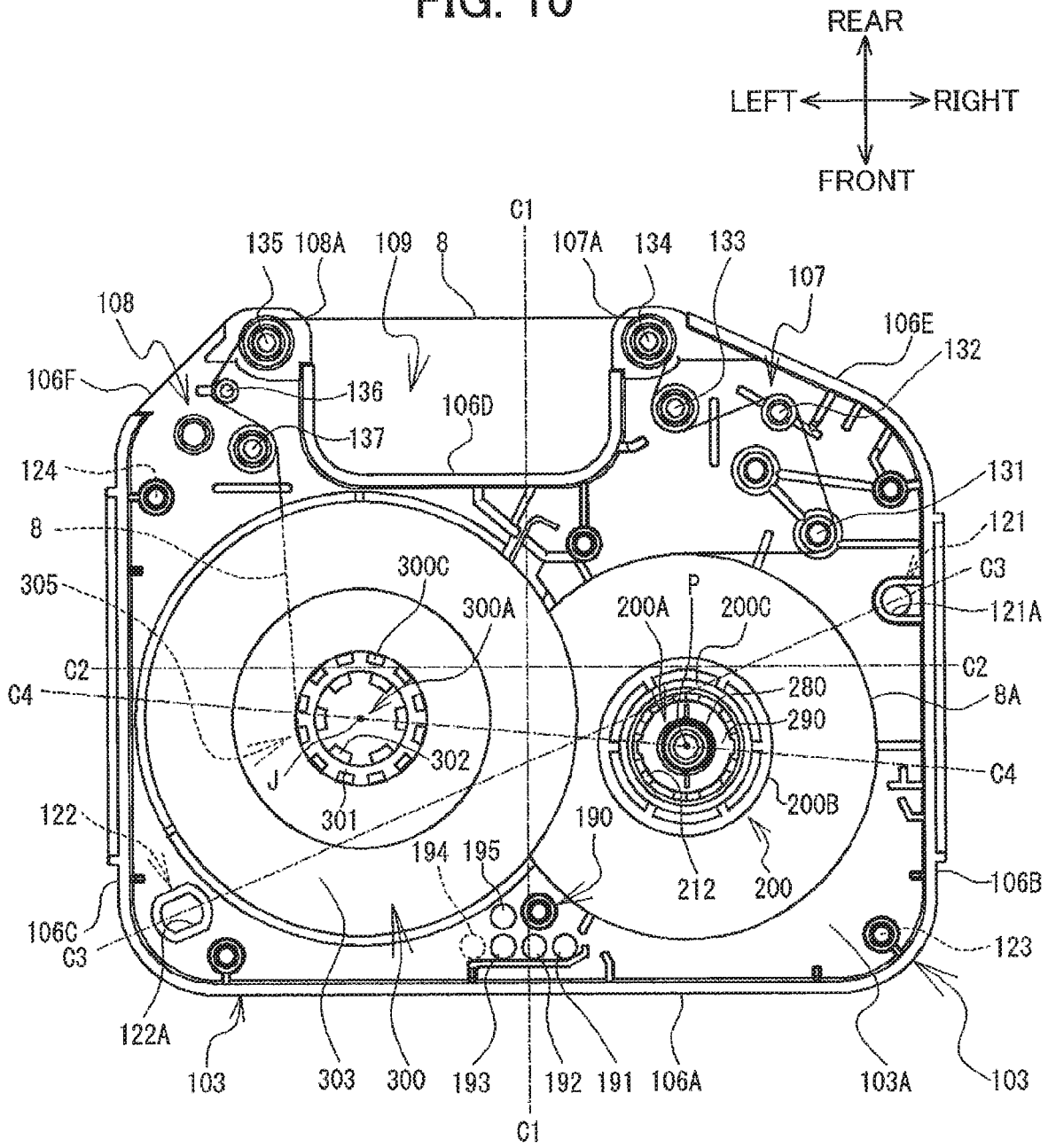
FIG. 10 is a plan view of a lower case 103.

As illustrated in FIGS. 4 and 10, the ink ribbon 8 is accommodated in the case 101 with its widthwise direction (transverse direction) oriented to be approximately parallel to the vertical direction. The ribbon spool 200 and take-up spool 300 are provided inside the case 101. With its widthwise direction oriented substantially parallel to the vertical direction, the ink ribbon 8 is conveyed from the ribbon spool 200 to the take-up spool 300 along a prescribed conveying path (hereinafter referred to as the ribbon-conveying path). The direction in which the ink ribbon 8 is conveyed along the ribbon-conveying path will be referred to as a ribbon-conveying direction. The ribbon spool 200 is a cylindrical member that is elongated vertically. One longitudinal end of the ink ribbon 8 (i.e., the upstream end in the ribbon-conveying direction) is wound about the ribbon spool 200. The take-up spool 300 is a cylindrical member that is elongated vertically. The other longitudinal end of the ink ribbon 8 (i.e., the downstream end in the ribbon-conveying direction) is coupled to the take-up spool 300.

A mounting hole 200A is provided in the ribbon spool 200 and penetrates the interior of the ribbon spool 200 vertically. The outer circumferential surface of the ribbon spool 200 is a supply surface 200B around which unused ink ribbon 8 is wound. Specifically, the unused ink ribbon 8 is wound around the supply surface 200B such that, of the two surfaces possessed by the ink ribbon 8, the ink surface to which ink is applied faces inward. The upper limit quantity of the ink ribbon 8 can be wound around the supply surface 200B on the ribbon spool 200. In the following description, the ink ribbon 8 that is wound around the supply surface 200B will be referred to as a first ribbon roll 8A. The outer diameter of the first ribbon roll 8A is a maximum value when the upper limit quantity of ink ribbon 8 is wound around the supply surface 200B. The upper limit quantity of ink ribbon 8 wound around the ribbon spool 200 will be referred to as a first ribbon roll 8A at maximum diameter.

Protruding parts 200C and 200D are respectively provided on the upper side and lower side of the ribbon spool 200. The protruding part 200C protrudes upward from the supply surface 200B, and the protruding part 200D protrudes downward from the supply surface 200B. A support part 140 (see FIG. 11) is provided on an inner surface 102A of the upper case 102. The support part 140 opposes the second support hole 112 vertically. The protruding part 200C is mounted into the support part 140 from below and is rotatably supported by the support part 140. The protruding part 200D is fitted into the second support hole 112 from above and is rotatably supported by the second support hole 112. In other words, the ribbon spool 200 is supported by the second support hole 112 and support part 140 so as to be freely rotatable. Hence, the axis P is substantially aligned with the center of the second support hole 112 in a plan view.

A cylindrical rotating member 290 is mounted on the top portion of the mounting hole 200A. A clutch spring 280 is wound about the rotating member 290. An end portion of the clutch spring 280 is anchored on the support part 140. The rotating member 290 can rotate together with the ribbon spool 200. The clutch spring 280 expands in diameter when the ribbon spool 200 rotates in a prescribed draw-out direction (in the present embodiment, the clockwise direction in a plan view). Accordingly, the clutch spring 280 applies a relatively small rotational load to the ribbon spool 200 via the rotating member 290. Rotational load is a load applied for deterring rotation of a member. Rotational load applies torque to the ribbon spool 200. The torque generated by this load is stable and does not change according to the size of the outer diameter of the first ribbon roll 8A.

On the other hand, the clutch spring 280 contracts in diameter when the ribbon spool 200 rotates in the direction opposite the draw-out direction. Accordingly, the clutch spring 280 applies a relative large rotational load to the ribbon spool 200 via the rotating member 290. In other words, the rotating member 290 allows the ribbon spool 200 to rotate stably in the draw-out direction and restrains the ribbon spool 200 from rotating in the direction opposite the draw-out direction because of the elastic force of the clutch spring 280.

As illustrated in FIGS. 4 and 10, the take-up spool 300 includes a main body 301, a plurality of engaging protrusions 302, an upper support plate 303, a lower support plate 304, and the like. The main body 301 is a hollow cylindrical body that is elongated vertically. A mounting hole 300A is provided in the main body 301, penetrating the center portion of the main body 301 vertically. The engaging protrusions 302 all protrude toward the axis J from the inner circumferential surface of the main body 301. The engaging protrusions 302 are arranged radially and at regular intervals about the axis J.

The outer circumferential surface of the main body 301 constitutes a take-up surface 300B. Used ink ribbon 8 is wound around the take-up surface 300B. Specifically, the used ink ribbon 8 is wound around the take-up surface 300B such that the ink surface among the two surfaces possessed by the ink ribbon 8 is on the outside. The upper limit quantity of ink ribbon 8 can be wound around the take-up surface 300B in this take-up spool 300. In the following description, the ink ribbon 8 wound around the take-up surface 300B will be referred to as a second ribbon roll 8B (see FIG. 3). The outer diameter of the second ribbon roll 8B is a maximum value when the upper limit quantity of ink ribbon 8 is wound around the take-up surface 300B. The upper limit quantity of ink ribbon 8 wound around the take-up spool 300 will be referred to as a second ribbon roll 8B at maximum diameter.

The upper support plate 303 is disc-shaped and extends radially outward from near the top end of the main body 301. The lower support plate 304 is disc-shaped and extends radially outward from near the bottom end of the main body 301. The upper support plate 303 and lower support plate 304 are plate-shaped members having the same diameter, and are arranged to oppose each other vertically. The distance between the upper support plate 303 and lower support plate 304 in the vertical direction is slightly larger than the length of the ink ribbon 8 in the widthwise direction. The region surrounded by the upper support plate 303, lower support plate 304, and take-up surface 300B is an accommodating section 305 that can accommodate the second ribbon roll 8B. The outer diameter of the accommodating section 305 is larger than the outer diameter of the second ribbon roll 8B at maximum diameter.

In the present embodiment, the upper support plate 303 is above the supply surface 200B, while the lower support plate 304 is below the supply surface 200B. The right edges of the upper support plate 303 and lower support plate 304 are located between the centerline C1 and the ribbon spool 200. That is, the accommodating section 305 is near the left side of the supply surface 200B. When a prescribed quantity or more of ink ribbon 8 is wound around the supply surface 200B, a portion of the first ribbon roll 8A enters the accommodating section 305 from the right side thereof. In other words, when the radius of the first ribbon roll 8A exceeds the distance from the axis P to the accommodating section 305, a portion of the first ribbon roll 8A is positioned in the accommodating section 305.

When the outer diameter of the first ribbon roll 8A is larger than a prescribed length in this way, a portion of the first ribbon roll 8A is accommodated in the accommodating section 305. Since the ribbon spool 200 and take-up spool 300 can be positioned in closer proximity to each other, the case 101 can be made more compact. As the ink ribbon 8 is conveyed, the outer diameter of the second ribbon roll 8B increases, while the outer diameter of the first ribbon roll 8A decreases. Accordingly, interference between the first ribbon roll 8A and second ribbon roll 8B can be avoided.

Protruding parts 300C and 300D are respectively provided on the top side and bottom side of the take-up spool 300. The protruding part 300C protrudes farther upward than the upper support plate 303, and the protruding part 300D protrudes farther downward than the lower support plate 304. The protruding part 300C is fitted into the upper hole 111A from below and is rotatably supported in the upper hole 111A. The protruding part 300D is fitted into the lower hole 111B from above and is rotatably supported in the lower hole 111B. In other words, the take-up spool 300 is supported by the first support hole 111 so as to be freely rotatable. Hence, the axis J is substantially aligned with the center of the first support hole 111 in a plan view.

As illustrated in FIG. 10, a plurality of bending parts 131-137 is provided inside the case 101. The bending parts 131-137 are members used to establish a meandering ribbon-conveying path. Each of the bending parts 131-137 is arranged upright on an inner surface 103A of the lower case 103 and extends upward to the upper case 102. The bending parts 131, 132, and 136 are columnar members that are fixed to the lower case 103. Specifically, the bending parts 131, 132, and 136 are integrally formed with the lower case 103. The bending parts 133-135 and 137 are hollow cylindrically shaped rotating bodies capable of rotating about a shaft oriented vertically.

The bending parts 131-134 are disposed in the right-rear portion of the case 101. The bending part 131 is positioned on the right-rear side of the second support hole 112 (see FIG. 9) in a plan view. The positioning hole 121 is positioned between the bending part 131 and the ribbon spool 200 in the front-rear direction. The bending part 131 is positioned between the positioning hole 121 and the ribbon spool 200 in the left-right direction. The bending part 131 is positioned between the head peripheral surface 106D and the ribbon spool 200 in the front-rear direction. The distance from the axis P to the bending part 131 is greater than the radius of the first ribbon roll 8A at maximum diameter. The bending parts 132-134 are positioned in the first guide part 107. The bending part 132 is on the left-rear side of the bending part 131. The bending part 133 is on the left side of the bending part 132. The bending part 134 is on the left-rear side of the bending part 133 and in the left-rear portion of the first guide part 107.

The bending parts 135-137 are disposed in the left-rear portion of the case 101. The bending parts 135-137 are positioned in the second guide part 108. The bending part 137 is on the left-rear side of the first support hole 111 (see FIG. 8). The distance from the axis J to the bending part 137 is greater than the radius of the second ribbon roll 8B at maximum diameter (see FIG. 3). The bending part 136 is on the left-rear side of the bending part 137. The bending part 135 is on the right-rear side of the bending part 136 and in the right-rear portion of the second guide part 108.

Figure 11:
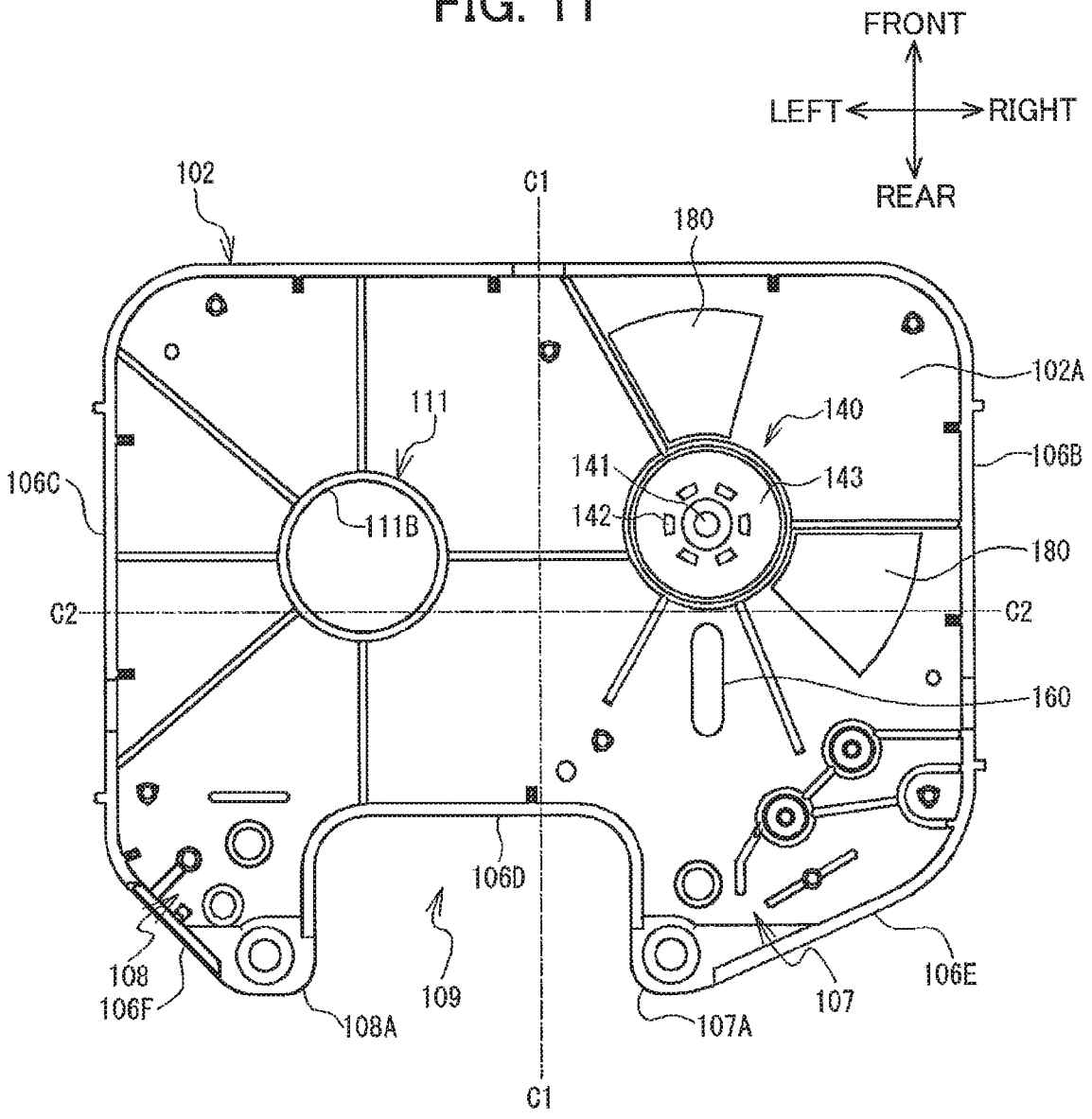
FIG. 11 is a bottom view of an upper case 102.

As illustrated in FIGS. 8 and 11, a window part 160 and at least one elastic body 180 are disposed in the upper case 102 around the support part 140. The window part 160 is an elongate hole that penetrates the upper case 102 vertically and extends in a radial direction relative to the support part 140. The window part 160 in the present embodiment extends rearward from the rear side of the support part 140. The rear end of the window part 160 is located on the outside of the first ribbon roll 8A at maximum diameter in a plan view. The user can discern the remaining quantity of unused ink ribbon 8 by visually inspecting the position of the outer diameter of the first ribbon roll 8A through the window part 160.

Each elastic body 180 is a plate-shaped sponge disposed on the inner surface 102A of the upper case 102. Each elastic body 180 extends in a radial direction centered on the support part 140. In a plan view, each elastic body 180 extends from the outer edge of the support part 140 to a position outside the first ribbon roll 8A at maximum diameter. As illustrated in FIG. 4, the elastic bodies 180 elastically contact the first ribbon roll 8A from above on the inside of the case 101. That is, the elastic bodies 180 contact the top surface of the first ribbon roll 8A across the entire first ribbon roll 8A in a radial direction thereof and urge the first ribbon roll 8A downward. In the present embodiment, two elastic bodies 180 are disposed respectively on the front side and the right-rear side of the support part 140. The elastic bodies 180 are identical plate-shaped sponges formed in a sector shape with a thickness of 4 mm and are affixed to the inner surface 102A of the upper case 102 with double-sided adhesive tape not illustrated in the drawings. When elastically contacting the first ribbon roll 8A, the elastic bodies 180 have a thickness of approximately 2 mm.

3. Operation Modes of Printing Device 1 and Ribbon Cassette 100

Operation modes of the printing device 1 and ribbon cassette 100 will be described while referring to FIGS. 2 through 4, 9, and 10. In the printing device 1, the moveable conveying roller 62 is displaced to the retracted position along with the opening of the cover 12. When the ribbon cassette 100 is mounted in the ribbon mounting section 30, the print head 61 is inserted into the head insertion section 109. The ribbon take-up shaft 63 is inserted through the lower hole 111B into the mounting hole 300A formed in the take-up spool 300. The plurality of protruding pieces 63A engage with the engaging protrusions 302. The rotatable detection shaft 71 is inserted through the second support hole 112 into the mounting hole 200A of the ribbon spool 200. As with the protruding pieces 63A, the plurality of protruding pieces 71A engage with the ribbon spool 200 in the mounting hole 200A.

The ribbon cassette 100 mounted in the ribbon mounting section 30 is placed in its proper position in the ribbon mounting section 30 as described below. The positioning pins 31 and 32 and the support pins 33 and 34 are inserted into the corresponding positioning holes 121 and 122 and pin holes 123 and 124, respectively. The top end of the support pin 33 contacts the top surface of the pin hole 123 to fix the vertical position of the ribbon cassette 100. The top end of the support pin 34 contacts the top surface of the pin hole 124 to fix the vertical position of the ribbon cassette 100. The top end of the positioning pin 31 is fitted tightly into the anchoring part 121A to fix the position of the ribbon cassette 100 in each of the up-down, left-right, and front-rear directions. The top end of the positioning pin 32 is fitted tightly into the anchoring part 122A to fix the position of the ribbon cassette 100 in each of the up-down, left-right, and front-rear directions. The support part 35 supports the front recessed part 125 from below to fix the vertical position of the ribbon cassette 100.

When the front recessed part 125 is supported by the support part 35, the five detection switches 81 are selectively pressed by the type indicating part 190. In the present embodiment, each of the indicators 191-195 respectively confronts one of the five detection switches 81. The detection switches 81 that confront the indicators 191-193 and 195 are inserted into the hole parts and held at the reference position. The switch 81 confronting the indicator 194 is pressed by the surface part and displaced to the depressed position.

The indicator detection unit 80 outputs a combination of OFF signals corresponding to detection switches 81 in the reference position, and ON signals corresponding to detection switches 81 in the depressed position to the CPU 41 (see FIG. 6) as a type detection pattern. The CPU 41 identifies the ribbon type corresponding to the type detection pattern received from the indicator detection unit 80 by referencing the table in the flash memory 45 (see FIG. 6). In this way, the printing device 1 can identify the ribbon type in the ribbon cassette 100 that is mounted in the ribbon mounting section 30.

The cover 12 is closed with the ribbon cassette 100 mounted in the ribbon mounting section 30 and the tube 9 mounted in the tube mounting section 40. When the cover 12 is closed, the moveable conveying roller 62 is displaced to the operating position. The moveable conveying roller 62 places the tube 9 in the tube mounting section 40 over the unused ink ribbon 8 and urges both the tube 9 and the ink ribbon 8 against the print head 61. At this time, the tube 9 elastically deforms by the urging force of the moveable conveying roller 62 and establishes surface contact with the print head 61 through the ink ribbon 8 (see FIG. 3).

When a print start command is inputted through the keyboard 7 or operating section 17, the CPU 41 drives the conveying motor 64 to rotate the moveable conveying roller 62 and ribbon take-up shaft 63. The tube 9 in the tube mounting section 40 is fed downstream in the tube-feeding direction along with the rotation of the moveable conveying roller 62. At this time, the unprinted tube 9 present outside the housing 10 is drawn into the tube mounting section 40 through the tube insertion opening 15.

Along with the rotation of the ribbon take-up shaft 63, the take-up spool 300 rotates in a take-up direction. The ribbon spool 200 rotates in a draw-out direction along with the rotation of the take-up spool 300. In this way, the ink ribbon 8 is pulled off the first ribbon roll 8A near the rear side thereof and is conveyed along the following ribbon-conveying path. As described above, when the ribbon spool 200 rotates in the draw-out direction, the elastic force of the clutch spring 280 applies a relatively small rotational load to the ribbon spool 200. Through this load, suitable tension is applied to the ink ribbon 8 being conveyed, reducing the potential for slack occurring in the ink ribbon 8.

After being pulled off the first ribbon roll 8A, the unused ink ribbon 8 passes sequentially over the right-front surface of the bending part 131, the right-rear surface of the bending part 132, the left-front surface of the bending part 133, and the right-rear surface of the bending part 134. Subsequently, the unused ink ribbon 8 is discharged from the case 101 through the ribbon outlet 107A and advances leftward through the head insertion section 109. At this time, the unused ink ribbon 8 passes between the tube 9 and print head 61.

The CPU 41 drives the print head 61 for heating the ink ribbon 8 passing between the tube 9 and print head 61 to print characters on the tube 9. In the present embodiment, the print head 61 prints characters as a normal image on the front side of the tube 9 passing over the rear side of the print head 61. Subsequently, the CPU 41 drives the cutting motor 93 to cut the printed tube 9 by moving the cutting blade 92 toward the receiving plate 91. The cut section of the tube 9 is discharged out of the housing 10 through the tube discharge opening 16.

The used ink ribbon 8 advances into the case 101 through the ribbon inlet 108A and passes over the left-rear surface of the bending part 135, the left surface of the bending part 136, and the right-rear surface of the bending part 137. Finally, the used ink ribbon 8 is taken up on the take-up spool 300 at the left side thereof and retained as the second ribbon roll 8B. In this way, the ink ribbon 8 is conveyed along the meandering ribbon-conveying path by passing over the plurality of bending parts 131-137. A suitable conveying load is applied to the ink ribbon 8 being conveyed along the ribbon-conveying path. The conveying load is applied for deterring conveyance of the ink ribbon 8. Since suitable tension is applied to the conveyed ink ribbon 8, slack is further unlikely to be produced in the ink ribbon 8.

Two elastic bodies 180 elastically contact the first ribbon roll 8A in a direction along the axis P. When the unused ink ribbon 8 is pulled from the first ribbon roll 8A, sliding friction is generated between the rotating first ribbon roll 8A and the elastic bodies 180. This sliding friction applies a suitable rotational load to the first ribbon roll 8A so that a suitable conveying load is applied to the ink ribbon 8 being pulled from the first ribbon roll 8A. Since a suitable tension is applied to the ink ribbon 8 being conveyed, slack is less likely to occur in the ink ribbon 8.

In the present embodiment, the two elastic bodies 180 are disposed at positions that do not overlap the upper support plate 303 (see FIGS. 4 and 10) in a plan view. This arrangement can prevent interference between the take-up spool 300 and the elastic bodies 180. The two elastic bodies 180 are disposed at different positions from the window part 160, thereby preventing the elastic bodies 180 from blocking the window part 160. The two elastic bodies 180 elastically contact the first ribbon roll 8A at different positions from each other in the circumferential direction. This arrangement ensures that a more suitable rotational load is applied over the entire first ribbon roll 8A than when the elastic bodies 180 elastically contact the first ribbon roll 8A disproportionately in one portion of the first ribbon roll 8A. Since the elastic bodies 180 are identical to each other, manufacturing the elastic bodies 180 is simplified.

When the outer diameter of the first ribbon roll 8A is at its minimum state, the first ribbon roll 8A is in danger of being bent in the widthwise direction when the elastic bodies 180 elastically contact the first ribbon roll 8A. In the present embodiment, the two elastic bodies 180 are arranged in positions different from the ink ribbon 8 between the ribbon spool 200 and bending part 131 when the outer diameter of the first ribbon roll 8A is at its minimum state. When the outer diameter of the first ribbon roll 8A is at its minimum state, the elastic bodies 180 do not contact the first ribbon roll 8A. This arrangement allows the ink ribbon 8 being pulled off the first ribbon roll 8A to avoid being bent in the widthwise direction by the elastic force of the elastic bodies 180.

Note that the rotatable detection shaft 71 also rotates in the draw-out direction along with the rotation of the ribbon spool 200. At this time, the sensor 73 outputs ON signals and OFF signals to the CPU 41 in correspondence with the light-receiving unit 73B intermittently detecting light emitted from the light-emitting unit 73A. The CPU 41 identifies the conveyance amount of the ink ribbon 8 corresponding to the rotated amount of the rotatable detection shaft 71 during a printing operation on the basis of the inputted ON/OFF signals. In other words, the printing device 1 can identify the quantity of ink ribbon 8 used since the beginning of a printing operation.

4. Detailed Description of Ribbon Spool 200

Figure 12:
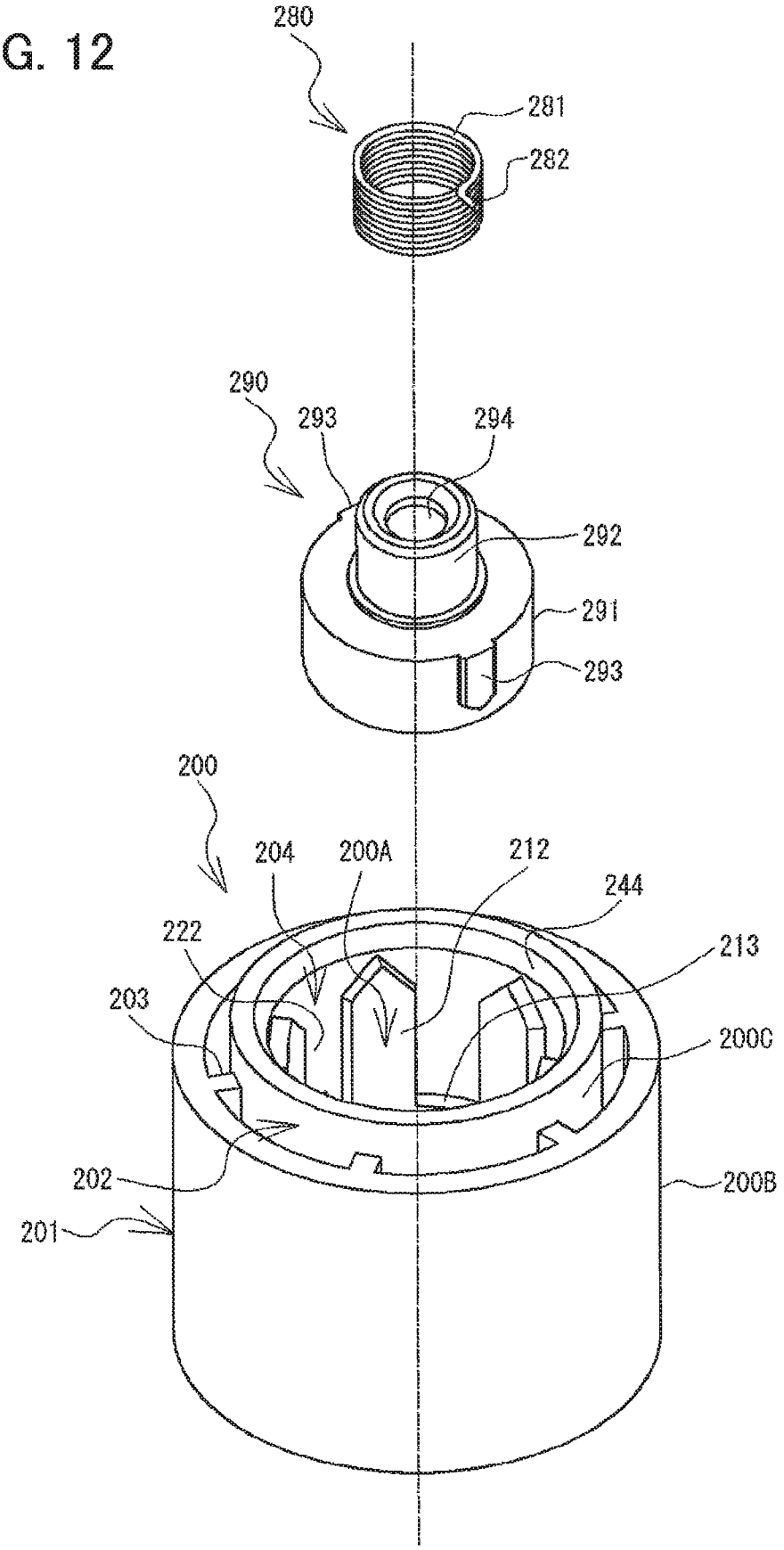
FIG. 12 is an exploded perspective view illustrating a clutch spring 280, a rotating member 290, and a ribbon spool 200.

A detailed structure related to the ribbon spool 200 will be described with reference to FIGS. 12 through 16. In the following description, upward and downward in FIG. 12 are defined as upward and downward for each of the ribbon spool 200, clutch spring 280, and rotating member 290.

Figure 13:
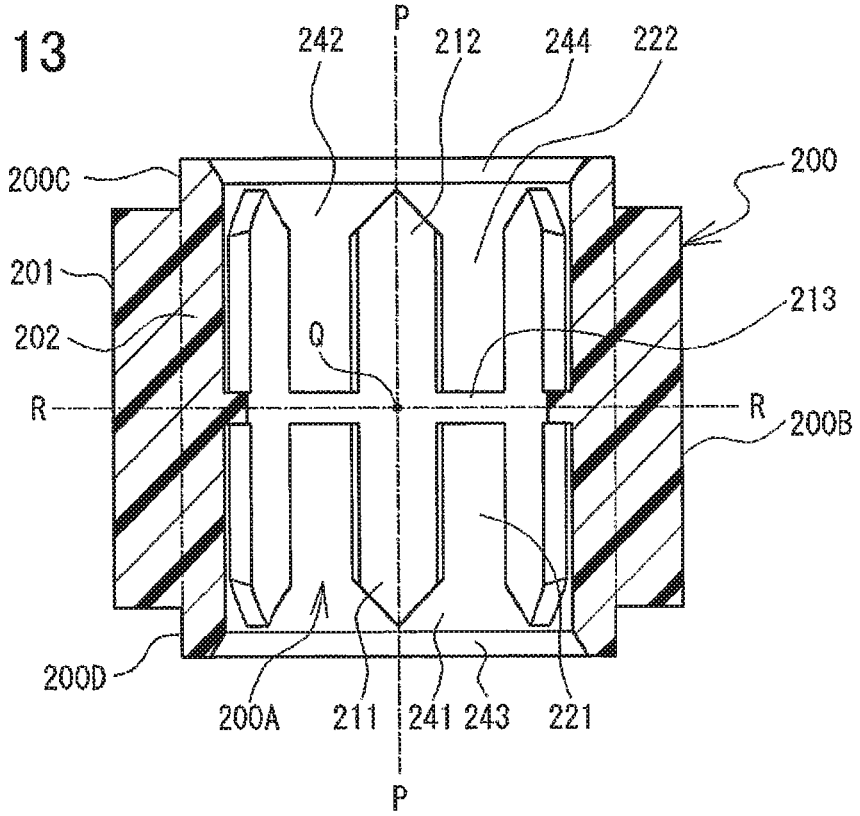
FIG. 13 is a vertical cross-sectional view of the ribbon spool 200.

The ribbon spool 200 will be described with reference to FIGS. 12 and 13. The ribbon spool 200 has an outer hollow cylinder 201, an inner hollow cylinder 202, and a plurality of connecting parts 203. The outer cylinder 201 and inner cylinder 202 are cylindrical members having the same axis, which is the axis P, and are elongated in the direction along the axis P (the vertical direction in the present embodiment). A center position within the mounting hole 200A that falls on the axis P is a spool center point Q. An imaginary plane that is orthogonal to the axis P and that passes through the spool center point Q is a center plane R.

The inner cylinder 202 has a diameter smaller than the outer cylinder 201 and is disposed inside the outer cylinder 201. The diameter of the inner cylinder 202 is slightly smaller than the diameter of the opening in the second support hole 112. The length of the outer cylinder 201 along the axis P is slightly larger than the length of the ink ribbon 8 (see FIG. 4) in the widthwise direction. The diameter of the outer cylinder 201 is slightly larger than the diameter of the opening in the second support hole 112 (see FIG. 4). The supply surface 200B described above is the outer circumferential surface of the outer cylinder 201.

The length of the inner cylinder 202 in the direction along the axis P is greater than the length of the outer cylinder 201 along the axis P and greater than the distance between the inner surface 102A of the upper case 102 (see FIGS. 4 and 16) and the inner surface 103A (see FIGS. 4 and 16) of the lower case 103. The center of the inner cylinder 202 along the axis P is coincident with the center of the outer cylinder 201 along the axis P. Accordingly, both ends of the inner cylinder 202 in the direction along the axis P protrude outward from the outer cylinder 201 along the axis P. The protruding part 200C described above is the part of the inner cylinder 202 that protrudes upward from the outer cylinder 201, and the protruding part 200D is the part of the inner cylinder 202 that protrudes downward from the outer cylinder 201. The protruding widths (i.e., the vertical dimension) of the protruding parts 200C and 200D are equal to each other.

The connecting parts 203 are disposed between the outer cylinder 201 and inner cylinder 202 and are provided radially and at regular intervals about the axis P. Each connecting part 203 extends along the inner circumferential surface of the outer cylinder 201 in the direction along the axis P and spans between the inner circumferential surface of the outer cylinder 201 and the outer circumferential surface of the inner cylinder 202. The connecting parts 203 integrally couple the outer cylinder 201 to the inner cylinder 202. The mounting hole 200A described above is the space surrounded by an inner surface 204 of the inner cylinder 202 that is elongated in the direction along the axis P. The inner surface 204 includes a lower inner surface 241 constituting the lower portion of the inner surface 204, and an upper inner surface 242 constituting the upper portion of the inner surface 204.

A tapered surface 243 is provided on the bottom end portion of the lower inner surface 241. The tapered surface 243 is a surface along the entire bottom end portion of the lower inner surface 241 that slopes in a direction away from the axis P toward the bottom edge. A tapered surface 244 is provided on the top end portion of the upper inner surface 242. The tapered surface 244 is a surface a along the entire top end portion of the upper inner surface 242 that slopes in a direction away from the axis P toward the top edge. In the present embodiment, the tapered surfaces 243 and 244 have vertical symmetry about the center plane R. Accordingly, the diameter of the opening in the mounting hole 200A is largest at the top and bottom edges thereof.

The ribbon spool 200 has at least one first protruding part 211, at least one second protruding part 212, and at least one third protruding part 213 as protruding parts that protrude from the inner surface 204 in a direction that intersects the axis P (inward along a radial direction orthogonal to the axis P in the present embodiment). In this example, six first protruding parts 211 are provided on the lower inner surface 241, six second protruding parts 212 are provided on the upper inner surface 242, and a single third protruding part 213 is provided on the inner surface 204 between the lower inner surface 241 and upper inner surface 242.

The six first protruding parts 211 are congruent protrusions having shapes and sizes identical to each other that are arranged radially and at regular intervals about the axis P. Each first protruding part 211 protrudes toward the axis P from the lower inner surface 241 and is elongated in a direction along the axis P. Each first protruding part 211 extends downward to near the bottom edge of the lower inner surface 241 (near the top edge of the tapered surface 243 in the present embodiment). Six first groove parts 221 that have congruent shapes are provided in the lower inner surface 241 radially and at regular intervals about the axis P. Each first groove parts 221 is formed between two neighboring first protruding parts 211.

The bottom end portion of each first protruding part 211 has surfaces that slope relative to the direction along the axis P so that the circumferential length of the bottom end portion gradually decreases toward the bottom edge. The bottom end portion of each first protruding part 211 has a triangular shape pointing downward when viewed from the axis P. Conversely, the circumferential length of each first groove part 221 at the bottom end portion thereof increases toward the bottom edge. The circumferential length of each first groove part 221 is largest at its bottom edge.

The six second protruding parts 212 are congruent protrusions that are provided radially and at regular intervals about the axis P. Each second protruding part 212 protrudes toward the axis P from the upper inner surface 242 and is elongated in the direction along the axis P. Each second protruding part 212 extends upward to near the top edge of the upper inner surface 242 (near the bottom edge of the tapered surface 244 in the present embodiment). Six second groove parts 222 that have congruent shapes are provided in the upper inner surface 242. The second groove parts 222 are arranged radially and at regular intervals about the axis P. Each second groove part 222 is formed between two neighboring second protruding parts 212.

The top end portion of each second protruding part 212 has surfaces that slope relative to the direction of the axis P so that the circumferential length of the second protruding part 212 gradually decreases toward the top edge. The top end portion of each second protruding part 212 has a triangular shape pointing upward when viewed from the axis P. Conversely, the circumferential length of each second groove part 222 increases toward the top edge in the top end portion of the second groove part 222. The circumferential length of each second groove part 222 is largest at the top edge.

In the present embodiment, the first protruding parts 211 and second protruding parts 212 are all congruent with each other. The six first protruding parts 211 are respectively aligned with the six second protruding parts 212 in a direction following the axis P since the first protruding parts 211 and second protruding parts 212 are at the same positions in the circumferential direction. In other words, the first protruding parts 211 and second protruding parts 212 are aligned with each other when viewed in the direction along the axis P (the vertical direction). The shortest distance from the spool center point Q to the first protruding parts 211 is the same for all six first protruding parts 211, and the shortest distance from the spool center point Q to the second protruding parts 212 is the same for all second protruding parts 212. The shortest distance from the spool center point Q to each first protruding part 211 is equal to the shortest distance from the spool center point Q to each second protruding part 212.

Two straight lines extending respectively along the shortest distance between the axis P and each circumferential edge of a first groove part 221 between two neighboring first protruding parts 211 form an angle that is not more than 100°. In the present embodiment, the first protruding parts 211 and first groove parts 221 are arranged at intervals of 30° from each other about the axis P in a plan view. Similarly, the second protruding parts 212 and second groove parts 222 are arranged at intervals of 30° from each other about the axis P in a plan view.

The third protruding part 213 protrudes toward the axis P from the inner surface 204 and extends along the entire inner surface 204 in the circumferential direction. The third protruding part 213 extends across the center plane R with vertical symmetry. The top end of each first protruding part 211 is connected to the bottom surface of the third protruding part 213, and the bottom end of each second protruding part 212 is connected to the top surface of the third protruding part 213. The protruding width (i.e., the length in the radial direction) of the third protruding part 213 is equivalent to the protruding width of each first protruding part 211 and the protruding width of each second protruding part 212. In other words, the shortest distance from the axis P to the protruding end of each first protruding part 211 (i.e., the inside end in the radial direction), the protruding end of each second protruding part 212, and the protruding end of the third protruding part 213 is the same. Hence, the protruding surface of the third protruding part 213 (i.e., the inside end face in the radial direction) is flush with the protruding surface of each first protruding part 211 and the protruding surface of each second protruding part 212.

According to the physical relationships described above, the ribbon spool 200 in the present embodiment is symmetric about the center plane R. Therefore, the six first protruding parts 211 and the six second protruding parts 212 are also symmetric about the center plane R. The outer appearance of the ribbon spool 200 does not change when the ribbon spool 200 is inverted about the center plane R, except that components symmetric to each other about the center plane R exchange positions. For example, when the ribbon spool 200 is inverted vertically about the center plane R to its mirror image, the six first protruding parts 211 exchange positions with the six second protruding parts 212.

Further, the ribbon spool 200 in the present embodiment is symmetric about the spool center point Q. Accordingly, the six first protruding parts 211 and six second protruding parts 212 are symmetric about the spool center point Q. The outer appearance of the ribbon spool 200 does not change when the ribbon spool 200 is inverted about the spool center point Q, except that components symmetric to each other about the spool center point Q exchange positions. For example, when the ribbon spool 200 is rotated 180° about the spool center point Q, the six first protruding parts 211 exchange positions with the six second protruding parts 212.

The clutch spring 280 and rotating member 290 will be described with reference to FIG. 12. First, the clutch spring 280 will be described. The clutch spring 280 has a coil-like annular part 281, and an extension part 282 that extends radially outward from the top end of the annular part 281.

The rotating member 290 has a bottom cylinder 291, and a top cylinder 292. The bottom cylinder 291 and top cylinder 292 are coaxial with each other and hollow cylindrical in shape and are aligned with each other in the vertical direction. The top cylinder 292 extends upward from the top surface of the bottom cylinder 291. The outer diameter of the top cylinder 292 is smaller than the outer diameter of the bottom cylinder 291 and approximately equal to the inner diameter of the annular part 281. Two anchoring protrusions 293 are provided on the outer circumferential surface of the bottom cylinder 291. The two anchoring protrusions 293 are symmetrically arranged about the rotational axis of the rotating member 290. Each anchoring protrusion 293 protrudes radially outward from the outer circumferential surface of the bottom cylinder 291 and is elongated vertically.

A shaft hole 294 is provided in the interior of the rotating member 290 and penetrates the rotating member 290 vertically. The shaft hole 294 includes a bottom hole 294A and a top hole 294B that are coaxial and elongated vertically (see FIG. 15). The bottom hole 294A is a recessed part surrounded by the inner circumferential surface of the bottom cylinder 291 and is open on the bottom of the rotating member 290. The top hole 294B extends upward from the bottom hole 294A and has a smaller diameter than the bottom hole 294A. The top hole 294B penetrates the interior of the top cylinder 292 and is open on the top of the rotating member 290.

Figure 14:
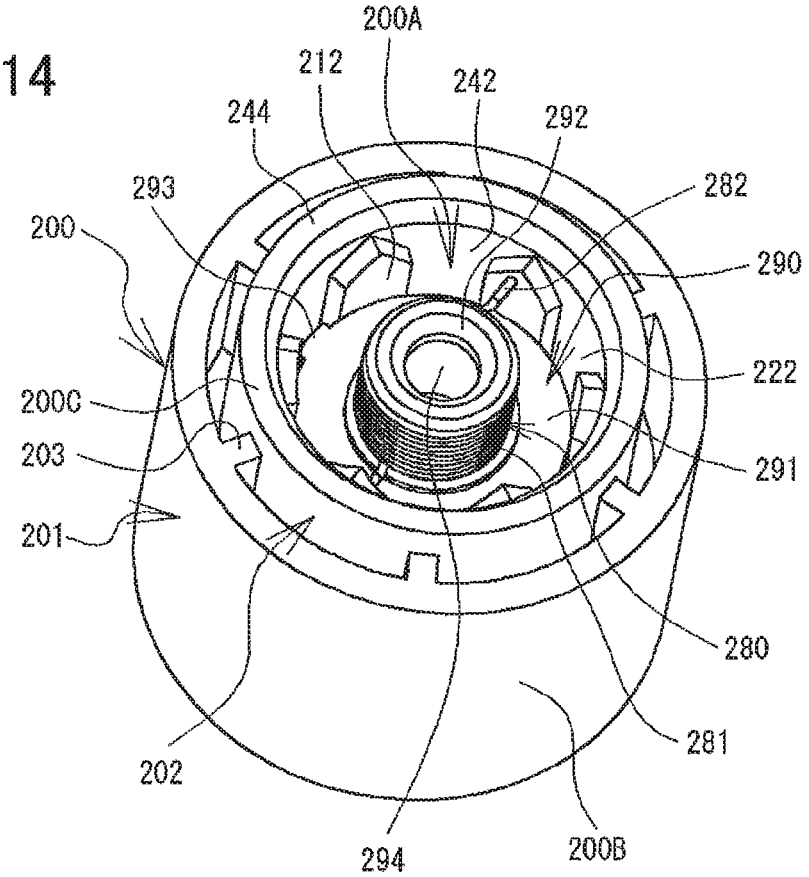
FIG. 14 is a perspective view of the ribbon spool 200 to which the clutch spring 280 and the rotating member 290 are assembled.
Figure 15:
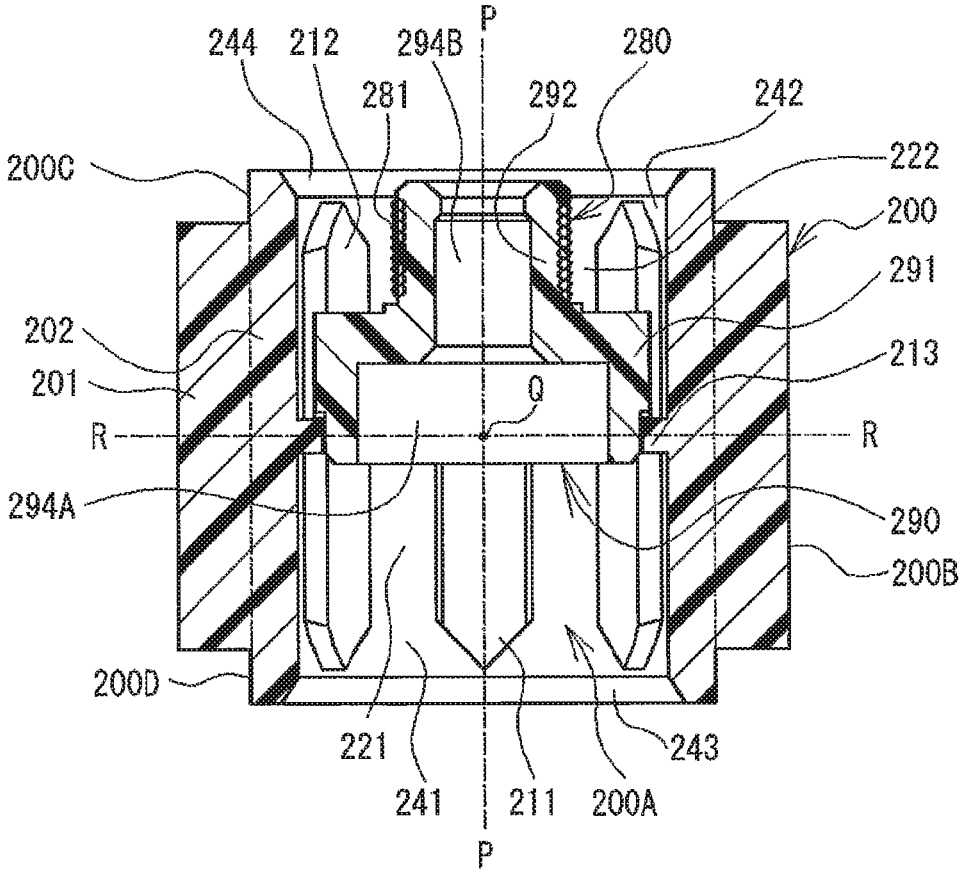
FIG. 15 is a vertical cross-sectional view of the ribbon spool 200 illustrated in FIG. 14.

The structure for assembling the clutch spring 280 and rotating member 290 in the ribbon spool 200 will be described with reference to FIGS. 14 and 15. The clutch spring 280 is mounted on the rotating member 290. More specifically, the clutch spring 280 is arranged around the outer circumference of the top cylinder 292 such that the top cylinder 292 is inserted through the winding center of the annular part 281, and the extension part 282 is disposed near the top edge of the top cylinder 292. With the clutch spring 280 mounted on the rotating member 290, the rotating member 290 is inserted into the mounting hole 200A from above so that the two anchoring protrusions 293 are fitted into two of the six second groove parts 222. Here, since the diameter of the opening in the top end of the mounting hole 200A is relatively large owing to the tapered surface 244, the rotating member 290 can be easily inserted into the top of the mounting hole 200A. The two anchoring protrusions 293 are also easily fitted into opposing second groove parts 222 from above, since the circumferential length of the second groove parts 222 is largest at their top ends.

When the rotating member 290 is inserted into the mounting hole 200A, the bottom edge of the bottom cylinder 291 is inserted into the inner circumference side of the third protruding part 213, and the two anchoring protrusions 293 contact the top end of the third protruding part 213. Hence, the third protruding part 213 holds the bottom end of the bottom cylinder 291 while supporting the two anchoring protrusions 293 from below. Each anchoring protrusion 293 engages with two second protruding parts 212 positioned on both circumferential sides thereof. In other words, the rotating member 290 is engaged in the upper inner surface 242 within the mounting hole 200A and is rotatable together with the ribbon spool 200. Inside the mounting hole 200A, the extension part 282 extends from the top edge of the annular part 281 in a direction orthogonal to the axis P. Since the distal end of the extension part 282 is positioned closer to the axis P than the protruding end of each second protruding part 212 is to the axis P, the extension part 282 does not contact the second protruding parts 212.

The structure for mounting the ribbon spool 200 in the ribbon cassette 100 will be described with reference to FIG. 16. With the clutch spring 280 and rotating member 290 assembled together, the ribbon spool 200 is mounted in the ribbon cassette 100 as follows. As described above, the protruding parts 200C and 200D of the ribbon spool 200 are rotatably supported by the support part 140 and second support hole 112, respectively.

More specifically, the bottom edge of the outer cylinder 201 is supported from below by the peripheral edge portion of the second support hole 112, while the protruding part 200D is inserted from above into the upper portion of the second support hole 112. The second support hole 112 supports the protruding part 200D so as to be freely rotatable in the circumferential direction, while restricting movement of the protruding part 200D in radial directions. At least part of the second support hole 112 overlaps the entire circular region surrounded by the rotational path of the protruding ends of the first protruding parts 211 in the direction along the axis P. In the present embodiment, the entire circular region surrounded by the rotational path of the protruding ends of the first protruding parts 211 is arranged on the inside of the second support hole 112 when viewed from the bottom.

The support part 140 is provided above the second support hole 112. The support part 140 has a support shaft 141, a plurality of engaging parts 142, and a supporting recessed part 143 (see FIG. 11). The supporting recessed part 143 is a region recessed upward from the inner surface 102A of the upper case 102. The supporting recessed part 143 is provided above the second support hole 112 and has a circular shape that approximately corresponds to the second support hole 112 in a bottom view. The support shaft 141 is a columnar body extending downward from the center portion of the supporting recessed part 143. In a bottom view, the axial center of the support shaft 141 is aligned with the center of the opening in the second support hole 112. The engaging parts 142 have columnar shaped bodies that extend downward from the supporting recessed part 143 radially outside the support shaft 141. The engaging parts 142 are arranged radially and at regular intervals about the support shaft 141.

Inside the case 101, the support part 140 rotatably supports the protruding part 200C as follows. The support shaft 141 is inserted from above into the top hole 294B of the rotating member 290. The engaging parts 142 are inserted from above into the mounting hole 200A and are disposed between the top cylinder 292 and upper inner surface 242. The engaging parts 142 are arranged along the rotational path of the extension part 282 of the clutch spring 280. The extension part 282 engages with one of the engaging parts 142 inside the mounting hole 200A. The protruding part 200C is inserted from below into the supporting recessed part 143. The supporting recessed part 143 supports the protruding part 200C so as to be freely rotatable in the circumferential direction, while restricting movement of the protruding part 200C in radial directions.

With this construction, the diameter of the annular part 281 expands inside the mounting hole 200A when an external force is applied to the ribbon spool 200 for rotating the ribbon spool 200 in the draw-out direction. In this case, the annular part 281 applies a relatively light rotational load to the top cylinder 292. Hence, the ribbon spool 200 rotates in the draw-out direction together with the rotating member 290 rotating about the support shaft 141. At this time, the ribbon spool 200 rotates stably due to the relatively light rotational load applied by the clutch spring 280. Suitable tension is applied to the ink ribbon 8 being pulled off the first ribbon roll 8A.

On the other hand, when an external force is applied to the ribbon spool 200 for rotating the ribbon spool 200 in the direction opposite the draw-out direction, the diameter of the annular part 281 contracts inside the mounting hole 200A. Since the annular part 281 applies a relatively large rotational load to the top cylinder 292 in this case, the rotation of the rotating member 290 is restricted. Accordingly, rotation of the ribbon spool 200 in the direction opposite the draw-out direction is restricted through the rotating member 290.

As described above, when the ribbon spool 200 is mounted in the ribbon mounting section 30, the rotatable detection shaft 71 is inserted through the second support hole 112 from below into the mounting hole 200A. At this time, the protruding pieces 71A are inserted into the mounting hole 200A and are fitted into any of the six first groove parts 221. Since the diameter of the opening in the bottom end of the mounting hole 200A is relatively large owing to the tapered surface 243, the rotatable detection shaft 71 is easily inserted into the bottom of the mounting hole 200A. The protruding pieces 71A are easily fitted into corresponding first groove parts 221 from below since the lengths of the first groove parts 221 in the circumferential direction are largest at their bottom ends.

When the rotatable detection shaft 71 is inserted into the mounting hole 200A, each protruding piece 71A is engaged with two first protruding parts 211 positioned on both circumferential sides of each protruding piece. In other words, the rotatable detection shaft 71 is engaged with the lower inner surface 241 inside the mounting hole 200A and is capable of rotating together with the ribbon spool 200. As described above, the ribbon spool 200 mounted in the ribbon mounting section 30 is fixed in position at a suitable height in the ribbon mounting section 30. As a result, the top end of the rotatable detection shaft 71 inserted into the mounting hole 200A is arranged inside the bottom hole 294A. Accordingly, the rotatable detection shaft 71 does not interfere with the rotating member 290 and, hence, does not hinder rotation of the ribbon spool 200.

5. Structural Features Related to Ribbon Spool 200

Some of the structural features of the ribbon cassette 100 in the present embodiment that primarily relate to the ribbon spool 200 will be illustrated with reference to FIGS. 12 through 16.

(5-1) The ribbon cassette 100 includes the box-shaped case 101. The ink ribbon 8 is accommodated inside the case 101. The hollow cylindrical ribbon spool 200 is supported in the case 101 so as to be freely rotatable, and one end of the ink ribbon 8 is wound about the ribbon spool 200. The hollow cylindrical take-up spool 300 is supported in the case 101 so as to be freely rotatable, and the other end of the ink ribbon 8 is wound around the take-up spool 300. The rotating member 290 is disposed in the mounting hole 200A constituting the inner portion of the ribbon spool 200 and engages with the upper inner surface 242, which is part of the inner surface 204 of the ribbon spool 200. The clutch spring 280 has the coil-like annular part 281 mounted on the rotating member 290, and the extension part 282 extending from the annular part 281. The engaging parts 142 are disposed in the case 101 and are arranged along the rotational path of the extension part 282.

The ribbon spool 200 has the first protruding parts 211 provided on the lower inner surface 241. The lower inner surface 241 is part of the inner surface 204 of the ribbon spool 200 and is located at a different position from the upper inner surface 242 in the direction along the axis P, which is the rotational axis of the ribbon spool 200. The first protruding parts 211 protrudes in radial directions orthogonal to the axis P of the ribbon spool 200.

The case 101 has the second support hole 112. The second support hole 112 is a hole for fitting the protruding part 200D, which is the end of the ribbon spool 200 closest to the lower inner surface 241. More specifically, the second support hole 112 is positioned closer to the lower inner surface 241 than the upper inner surface 242 and communicates with the mounting hole 200A. At least part of the second support hole 112 overlaps the entire circular region surrounded by the rotational path of the radially protruding ends of the first protruding parts 211 in the direction along the axis P.

According to this construction, the clutch spring 280 and the rotating member 290 are components that apply rotational load to the ribbon spool 200 (hereinafter referred to as rotational load components). Since a rotational load is applied to the ribbon spool 200 by the rotational load components, the ink ribbon 8 is pulled stably from the ribbon spool 200, and suitable tension is applied to the ink ribbon 8 being pulled. Further, exposing the mounting hole 200A outside the case 101 through the second support hole 112 provides the following advantage in the manufacturing process of the ribbon cassette 100.

When a worker inspects a manufactured ribbon cassette 100, for example, the worker visually examines the mounting hole 200A through the second support hole 112. In this way, the worker can confirm whether the rotating member 290 is mounted in the mounting hole 200A. The worker inserts a finger or a screwdriver, for example, into the mounting hole 200A through the second support hole 112. The worker can confirm that the clutch spring 280 is properly mounted based on the magnitude of load felt when rotating the first protruding part 211 using the inserted finger or inspection tool. Hence, the worker can easily inspect unit ribbon cassettes 100 to determine whether the rotational load components are properly mounted in the ribbon spool 200.

Note that the rotatable detection shaft 71 engages with the first protruding parts 211 when inserted into the ribbon spool 200 via the second support hole 112, for example. Consequently, the rotatable detection shaft 71 can rotate together with the ribbon spool 200. The printing device 1 can identify the quantity of ink ribbon 8 used during a printing operation based on the rotation amount of the rotatable detection shaft 71.

(5-2) The ribbon spool 200 has the second protruding parts 212 disposed on the upper inner surface 242. The second protruding parts 212 engage with the rotating member 290. According to this structure, the rotating member 290 can be engaged with the upper inner surface 242 through a simple construction in which protruding parts are provided on the upper inner surface 242.

(5-3) The distance from the first protruding parts 211 to the spool center point Q is equivalent to the distance from the second protruding parts 212 to the spool center point Q. The spool center point Q is the point on the axis P at the center of the mounting hole 200A.

According to this structure, if the ribbon spool 200 is mounted in the case 101 while inverted in the direction along the axis P, the positions of the first protruding parts 211 in the direction along the axis P are exchanged with the positions of the second protruding parts 212 in the direction along the axis P. In this case, the rotating member 290 can engage with the lower inner surface 241 by engaging with the first protruding parts 211. Accordingly, the rotational load components can apply rotational load to the ribbon spool 200 in the same manner as when the rotating member 290 is engaged with the upper inner surface 242. The worker can inspect the mounted states of the rotational load components by visually examining the mounting hole 200A via the second support hole 112 and manipulating the second protruding part 212 to rotate via the second support hole 112.

Incidentally, by engaging the rotatable detection shaft 71 with the second protruding parts 212 when the rotatable detection shaft 71 is inserted into the mounting hole 200A through the second support hole 112, the rotatable detection shaft 71 can rotate together with the ribbon spool 200. The printing device 1 can identify the quantity of ink ribbon 8 used during a printing operation based on the rotation amount of the rotatable detection shaft 71.

(5-4) The first protruding parts 211 and second protruding parts 212 overlap each other in the direction along the axis P. According to this configuration, the first protruding parts 211 and second protruding parts 212 are arranged in the same positions along the circumferential direction. Accordingly, the ribbon spool 200 can be manufactured more easily and precisely than when the first protruding parts 211 and second protruding parts 212 are arranged at different positions from each other along the circumferential direction.

(5-5) The first protruding parts 211 and second protruding parts 212 are symmetric to each other about an imaginary point or imaginary plane centrally located. With this construction, the first protruding parts 211 and second protruding parts 212 have symmetric shapes. Accordingly, the rotating member 290 can smoothly engage with the second protruding parts 212 and the worker can inspect the mounted states of the rotational load components, even if the ribbon spool 200 mounted in the case 101 is inverted in the direction along the axis P. For example, the rotatable detection shaft 71 can smoothly engage with the first protruding parts 211.

(5-6) The shortest distance from the radially protruding ends of the first protruding parts 211 to the axis P is equivalent to the shortest distance from the radial ends of the second protruding parts 212 to the axis P. With this construction, the shortest distance from the axis P to the first protruding parts 211 and second protruding parts 212 is the same. Accordingly, the rotating member 290 can smoothly engage with the second protruding parts 212, and the worker can inspect the mounted states of the rotational load components, even if the ribbon spool 200 mounted in the case 101 is inverted in the direction along the axis P. Similarly, the rotatable detection shaft 71 can smoothly engage with the first protruding parts 211, for example.

(5-7) The first protruding parts 211 extend to a point near the edge of the lower inner surface 241 on the opposite side from the upper inner surface 242. The second protruding parts 212 extend to a point near the edge of the upper inner surface 242 on the opposite side from the lower inner surface 241. With this construction, the rotating member 290 easily engages with the first protruding parts 211 when inserted into the mounting hole 200A. The worker's finger, inspection tool, or rotatable detection shaft 71 easily engages with the second protruding parts 212 when inserted into the mounting hole 200A through the second support hole 112.

(5-8) The ribbon spool 200 has the third protruding part 213 that is disposed on the inner surface 204 between the lower inner surface 241 and upper inner surface 242 and that contacts the rotating member 290 in a direction along the axis P. With this construction, the rotating member 290 inserted into the mounting hole 200A can be restricted from moving past the third protruding part 213 in a direction along the axis P.

(5-9) The third protruding part 213 is located at the center position in the ribbon spool 200 in the direction along the axis P. With this construction, the third protruding part 213 can support the rotating member 290 inserted into the mounting hole 200A at an appropriate position in the direction along the axis P, even when the ribbon spool 200 mounted in the case 101 has been inverted in the direction along the axis P.

(5-10) The radially protruding end of the third protruding part 213 extends in the direction along the axis P across the center position of the ribbon spool 200 relative to the direction along the axis P. With this construction, the rotating member 290 inserted into the mounting hole 200A can be restrained from moving toward the lower inner surface 241 side.

(5-11) The rotating member 290 has the shaft hole 294 that overlaps at least part of the second support hole 112 in the direction along the axis P. According to this structure, positioning the rotatable detection shaft 71 in the shaft hole 294 when the rotatable detection shaft 71 is inserted into the mounting hole 200A through the second support hole 112, for example, can prevent the rotatable detection shaft 71 from interfering with the rotating member 290.

(5-12) The ribbon spool 200 has a symmetric shape in the direction along the axis P. According to this configuration, the ribbon spool 200 and ribbon cassette 100 can be manufactured easily and precisely, without the worker needing to consider the orientation of the ribbon spool 200 in the direction along the axis P.

(5-13) The first protruding parts 211 are positioned closer to the second support hole 112 than the center position of the ribbon spool 200 in the direction along the axis P. With this construction, the worker can easily inspect the mounted states of the rotational load components since a finger or inspection tool inserted through the second support hole 112 easily engages with the second protruding parts 212.

(5-14) The ribbon spool 200 has a plurality of first protruding parts 211 arranged along the circumferential direction. Two straight lines extending respectively along the shortest distance between the axis P and each circumferential edge of an area between two neighboring first protruding parts 211 form an angle of not more than 100°. With this construction, the worker can easily inspect the mounted states of the rotational load components, since a finger or inspection tool inserted through the second support hole 112 engages with one of the first protruding parts 211.

(5-15) The first protruding parts 211 have surfaces that slope relative to the direction along the axis P such that the length of the first protruding parts 211 along the circumferential direction decreases gradually toward the second support hole 112. With this construction, the worker can easily inspect the mounted states of the rotational load components, since a finger or inspection tool inserted through the second support hole 112 easily engages with the first protruding parts 211.

6. Structural Features Related to Ribbon-Conveying Path

Some of the structural features of the ribbon cassette 100 in the present embodiment that primarily relate to the ribbon-conveying path will be illustrated with reference to FIGS. 10 and 17.

(6-1) The front end of the bending part 131 is positioned farther rearward than the rear end of the ribbon spool 200. The right end of the bending part 131 is positioned farther rightward than the right end of the ribbon spool 200. The right end of the bending part 131 is positioned farther leftward than the right end of the first ribbon roll 8A when the predetermined upper limit quantity of ink ribbon 8 is wound around the ribbon spool 200. In other words, the right end of the bending part 131 is positioned farther leftward than the right end of the first ribbon roll 8A at maximum diameter. A tangent to both a portion of the circumferential surface of the bending part 131 along which the ribbon-conveying path passes and a portion of the circumferential surface of the bending part 132 along which the ribbon-conveying path passes is an imaginary line K1. A tangent to a portion of the circumferential surface of the bending part 131 along which the ribbon-conveying path passes that is orthogonal to the vertical direction and the imaginary line K1 is an imaginary line K2. The imaginary line K2 passes between the outer circumference of the ribbon spool 200 (i.e., the supply surface 200B) and the outer circumference of the first ribbon roll 8A at maximum diameter.

According to this construction, paths L1 and L2 included in the ribbon-conveying path have the following positional relationship. The path L1 is a segment of the path linearly connecting the first ribbon roll 8A and the circumferential surface of the bending part 131. The path L2 is a segment of the path linearly connecting the circumferential surfaces of the bending parts 131 and 132 that falls on the imaginary line K1. An angle formed by the paths L1 and L2 and defining the region that includes the bending part 131 will be referred to as angle α1. The position at which the ink ribbon 8 is pulled off the first ribbon roll 8A will be referred to as a draw-out position 3.

Figure 17:
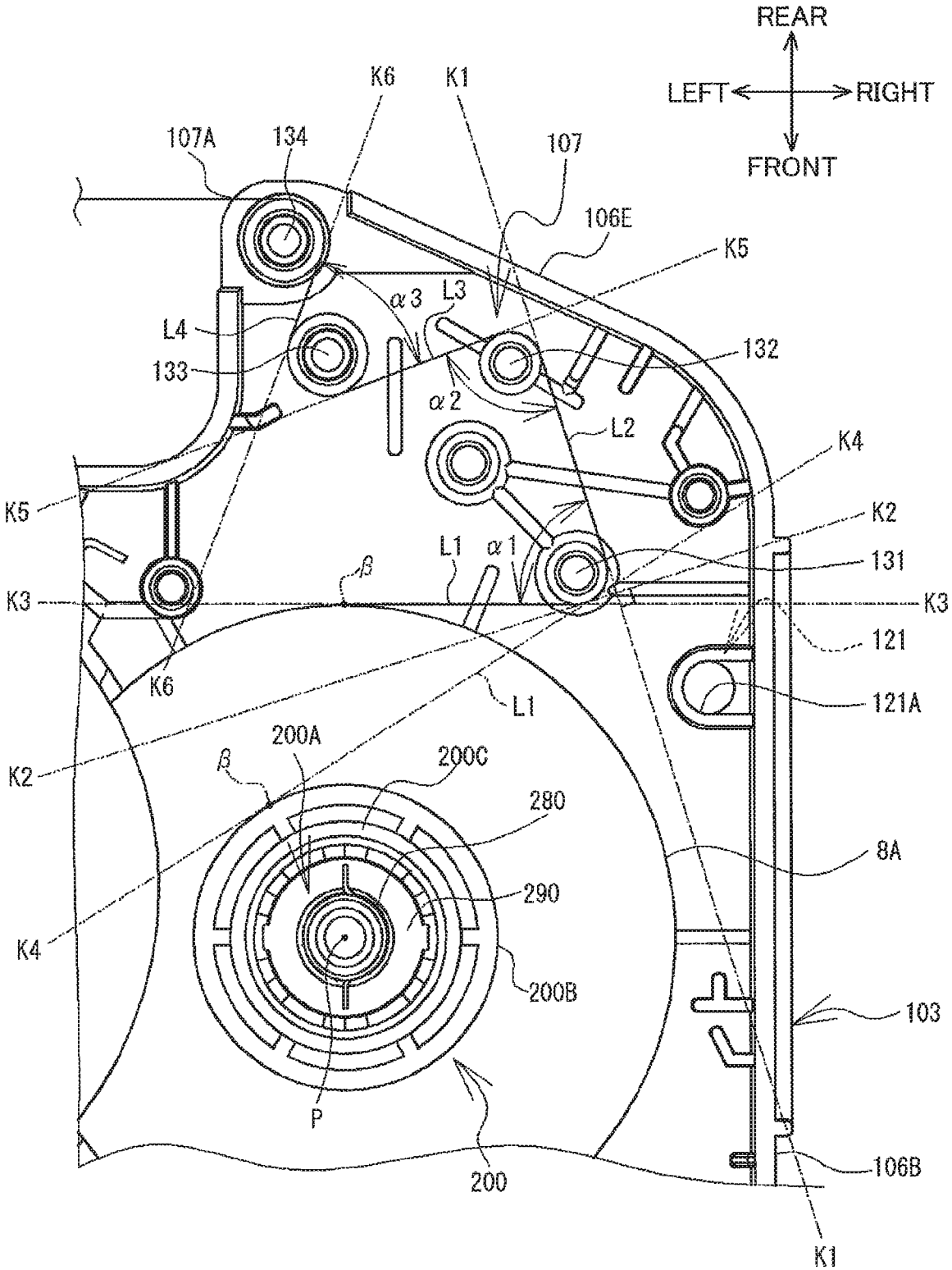
FIG. 17 is an enlarged view illustrating a first guide part 107 and components ambient thereto.

As illustrated in FIGS. 10 and 17, angle α1 is an acute angle when the first ribbon roll 8A is at the maximum diameter. At this time, the ink ribbon 8 is bent and conveyed at an acute angle around the bending part 131, which is the bending part among the plurality of bending parts 131-137 positioned most upstream on the ribbon-conveying path. Accordingly, a relatively large conveying load is applied to the ink ribbon 8 being conveyed. This load can suppress the ink ribbon 8 from being pulled improperly off the first ribbon roll 8A due to vibrations in the ribbon spool 200 and the like, for example.

The diameter of the first ribbon roll 8A gradually decreases as the ink ribbon 8 is pulled off the first ribbon roll 8A. As a consequence, the draw-out position β moves forward, gradually increasing angle α1. When the draw-out position β moves farther forward than the imaginary line K2, angle α1 becomes an obtuse angle. When the first ribbon roll 8A is at its minimum diameter, the draw-out position β has moved to the most forward side and angle α1 is maximum value (see the imaginary line K4 in FIG. 17). In this way, the conveying load applied to the ink ribbon 8 via the bending part 131 decreases as the outer diameter of the first ribbon roll 8A decreases (i.e., as the angle α1 increases).

In the ribbon cassette 100 of the present embodiment, the tension generated when the ink ribbon 8 is pulled from the draw-out position β increases, as the outer diameter of the first ribbon roll 8A decreases. Torque is applied to the ribbon spool 200 by the rotational load generated when the diameter of the clutch spring 280 expands. The tension generated when pulling the ink ribbon 8 from the draw-out position β increases as the outer diameter of the first ribbon roll 8A decreases. The tension increases because an increase in torque is inversely proportional to a decrease in the outer diameter of the first ribbon roll 8A, since torque is expressed as the product of tension and the radius of rotation.

While the conveying load applied to the ink ribbon 8 via the bending part 131 decreases as the outer diameter of the first ribbon roll 8A decreases, the tension generated in the ink ribbon 8 at the draw-out position β increases. Therefore, tension in the ink ribbon 8 at a position downstream of the bending part 132 remains stable, even when the outer diameter of the ink ribbon 8 changes.

Further, in the present embodiment, the bending part 131 is positioned between the right end of the ribbon spool 200 and the right end of the first ribbon roll 8A at maximum diameter in the left-right direction. Consequently, the bending part 131 in the present embodiment can increase the amount of change in the angle α1 as the ink ribbon 8 is conveyed more than if the bending part 131 were disposed on the right side of the first ribbon roll 8A at maximum diameter. The reason for this is that the bending part 131 in the present embodiment is disposed at a position closer to the draw-out position β than if the bending part 131 were disposed on the right side of the first ribbon roll 8A at maximum diameter. Further, the bending part 131 of the present embodiment can suppress an increase in the size of the case 101 in the left-right direction better than if the bending part 131 were disposed on the right side of the first ribbon roll 8A at maximum diameter.

(6-2) A tangent to both a portion of the circumferential surface of the bending part 131 along which the ribbon-conveying path passes and a portion on the outer circumference of the first ribbon roll 8A at maximum diameter is an imaginary line K3. An angle formed by the imaginary lines K1 and K3 and defining the region that includes the bending part 131 is an acute angle. A tangent to both a portion of the circumferential surface of the bending part 131 along which the ribbon-conveying path passes and a portion of the circumferential surface of the ribbon spool 200 is an imaginary line K4. An angle formed by the imaginary lines K1 and K4 and defining the region that includes the bending part 131 is an obtuse angle.

According to this structure, when the first ribbon roll 8A is at its maximum diameter the path L1 falls on the imaginary line K3. An angle formed by the imaginary lines K1 and K3 and defining the region that includes the bending part 131 corresponds to angle α1 when the first ribbon roll 8A is at its maximum diameter. The path L1 when the first ribbon roll 8A is at its minimum diameter falls on the imaginary line K4. An angle formed by the imaginary lines K1 and K4 and defining the region that includes the bending part 131 corresponds to angle α1 when the first ribbon roll 8A is at its minimum diameter. Hence, the bending part 131 can modify the conveying load applied to the ink ribbon 8 by greatly changing angle α1 from an acute angle to an obtuse angle as the ink ribbon 8 is conveyed.

(6-3) A tangent to both a portion of the circumferential surface of the engaging parts 142 along which the ribbon-conveying path passes and a portion of the circumferential surface of the supporting recessed part 143 along which the ribbon-conveying path passes is an imaginary line K5. Among the angles formed by the imaginary lines K1 and K5, the angle defining the region that includes the bending part 132 is an acute angle.

With this structure, paths L2 and L3 included in the ribbon-conveying path have the following positional relationship. Path L3 is a segment of the path linearly connecting the circumferential surfaces of the bending parts 132 and 133 and falls on the imaginary line K5. Among the angles formed by the paths L2 and L3, the angle defining the region that includes the bending part 132 will be referred to as angle α2. Among the angles formed by the imaginary lines K1 and K5, the angle defining the region that includes the bending part 132 corresponds to angle α2. A relatively large conveying load is applied to the ink ribbon 8 being bent and conveyed at an acute angle around the bending part 132, thereby further suppressing the ink ribbon 8 from being pulled unsuitably off the first ribbon roll 8A.

(6-4) A tangent to both a portion of the circumferential surface of the bending part 133 along which the ribbon-conveying path passes and a portion of the circumferential surface of the bending part 134 along which the ribbon-conveying path passes is an imaginary line K6. Among the angles formed by the imaginary lines K5 and K6, the angle defining the region that includes the bending part 133 is an acute angle.

According to this structure, paths L3 and L4 included in the ribbon-conveying path have the following positional relationship. Path L4 is a segment of the path linearly connecting the circumferential surfaces of the bending parts 133 and 134 and falls on the imaginary line K6. Among the angles formed by the paths L3 and L4, the angle defining the region that includes the bending part 133 will be referred to as angle α3. Among the angles formed by the imaginary lines K5 and K6, the angle defining the region that includes the bending part 133 corresponds to angle α3. A relatively large conveying load is applied to the ink ribbon 8 being bent and conveyed at an acute angle around the bending part 133, thereby further suppressing the ink ribbon 8 from being in appropriately off the first ribbon roll 8A.

(6-5) The bending parts 131 and 132 are fixed to the case 101. The bending part 133 is a rotating body that is rotatable about an axis oriented in the direction along the axis P With this structure, since the bending parts 131 and 132 disposed most upstream along the ribbon-conveying path are columnar bodies that are fixed to the case, a relatively large conveying load is applied to the ink ribbon 8, thereby further suppressing the ink ribbon 8 from being pulled inappropriately off the first ribbon roll 8A. On the other hand, the bending part 133 positioned downstream of the bending parts 131 and 132 on the ribbon-conveying path is a rotating body that directly contacts the ink surface side of the ink ribbon 8, enabling the sliding load between the ink surface of the ink ribbon 8 and the bending part 133 to be set to a relatively small conveying load. Hence, ink ribbon 8 pulled suitably from the first ribbon roll 8A can be conveyed stably.

(6-6) The bending parts 131 and 132 are integrally formed with the case 101. This structure can easily provide bending parts 131 and 132 with high physical strength.

(6-7) The ink ribbon 8 is wound around the ribbon spool 200 such that the ink surface to which ink is applied among the two surfaces on the ink ribbon 8 is facing inward. The bending parts 131 and 132 contact the surface of the ink ribbon 8 on the opposite side of the ink surface. The bending part 133 contacts the ink surface of the ink ribbon 8. With this configuration, the bending parts 131 and 132 contact the surface on the opposite side of the ink surface of the ink ribbon 8 being conveyed, and the bending part 133 rotates while in contact with the ink surface of the ink ribbon 8 being conveyed. Hence, this configuration can restrain the bending parts 131-133 from damaging to the ink surface of the ink ribbon 8.

7. Structural Features Related to Case 101

Some of the structural features of the ribbon cassette 100 in the present embodiment that primarily relate to the case 101 will be described with reference to FIGS. 8 through 10.

(7-1) The axis P, which is the rotational axis of the ribbon spool 200, is positioned on the right side of the centerline C1 extending in the front-rear direction through the left-right center of the case 101. The axis J, which is the rotational axis of the take-up spool 300, is positioned on the left side of the centerline C1. With this configuration, the heavy ribbon spool 200 and take-up spool 300 are juxtaposed in the left-right direction in the case 101, thereby improving the weight balance of the ribbon cassette 100.

(7-2) The case 101 has the positioning holes 121 and 122. The positioning hole 121 is an opening provided on the rear side of the centerline C2, which extends in the left-right direction and passes through the front-rear center of the case 101. The positioning hole 122 is an opening provided on the front side of the centerline C2. With this configuration, users and workers can readily discern the directions of the case 101 based on the positional relationship of the positioning holes 121 and 122.

(7-3) One of the positioning holes 121 and 122 is the elongate hole. The positioning holes 121 and 122 are juxtaposed along the longitudinal direction of the elongate hole. In the present embodiment, the positioning hole 122 is the elongated hole. With this construction, users and workers can visually identify the positioning hole 121 that is not the elongate hole using the elongated positioning hole 122 as reference. The support pins 33 and 34 can be suitably inserted into the positioning holes 121 and 122, even when there is slight dimensional error in the distance between the positioning holes 121 and 122 and the distance between the support pins 33 and 34. Thus, this configuration reduces the burden of manufacturing the ribbon cassette 100.

(7-4) The axis P is positioned on the right side of the connecting line C3, which is the line connecting the positioning holes 121 and 122, and the axis J is positioned on the left side of the connecting line C3. Since the rotational axes of the heavy ribbon spool 200 and take-up spool 300 are arranged on opposing sides of the connecting line C3 with this configuration, the support pins 33 and 34 inserted into the positioning holes 121 and 122 can support the ribbon cassette 100 with good balance, for example.

(7-5) The positioning hole 121 is positioned between the bending part 131 and the axis P in the front-rear direction. This configuration can suppress an increase in the size of the case 101 in the front-rear direction better than if the positioning hole 121 were disposed on the rear side of the bending part 131 or on the front side of the axis P, for example.

(7-6) The bending part 131 is disposed between the positioning hole 121 and the axis P in the left-right direction. This configuration can suppress an increase in the size of the case 101 in the left-right direction better than if the bending part 131 were disposed on the right side of the positioning hole 121 or on the left side of the axis P, for example.

(7-7) The bending part 131 is disposed between the head peripheral surface 106D and the axis P in the front-rear direction. This configuration can suppress an increase in the size of the case 101 in the front-rear direction better than if the bending part 131 were disposed on the rear side of the head peripheral surface 106D or on the front side of the axis P, for example.

(7-8) The case 101 has at least one through-hole. In the present embodiment, the hole parts included in the type indicating part 190 are the one or more through-holes. The one or more through-holes are positioned between the ribbon spool 200 and the take-up spool 300 in the left-right direction. This configuration can suppress an increase in the size of the case 101 in the front-rear direction better than if the one or more through-holes were arranged on the right side of the ribbon spool 200 or on the left side of the take-up spool 300, for example.

(7-9) The at least one through-hole is provided on the front side of the connecting line C4 intersecting the axes J and P and is aligned with the head peripheral surface 106D in the front-rear direction. With this configuration, the at least one through-hole is aligned with the head peripheral surface 106D in the front-rear direction interposing the connecting line C4 between the at least one through hole and the head peripheral surface 106D. Therefore, the user or worker can visually identify the at least one through-hole with reference to the axes J and P and the head peripheral surface 106D.

(7-10) The axis P is positioned on the front side of the axis J. With this configuration, the user or worker can easily visually identify the ribbon spool 200 and take-up spool 300 based on the front-rear positions of the rotational axes of the ribbon spool 200 and take-up spool 300.

(7-11) The ribbon cassette 100 is provided with the elastic bodies 180. The elastic bodies 180 elastically contact the first ribbon roll 8A, which is the ink ribbon 8 wound around the ribbon spool 200, in a direction along the axis P. With this construction, rotational load generated by the elastic force of the elastic bodies 180 can stably rotate the first ribbon roll 8A and can apply suitable tension to the ink ribbon 8 being pulled off the first ribbon roll 8A.

(7-12) The elastic bodies 180 elastically contact the first ribbon roll 8A at different positions in the circumferential direction. This configuration can apply a suitable rotational load to the entire first ribbon roll 8A.

(7-13) The elastic bodies 180 are identical members. With this construction, the plurality of elastic bodies 180 can be easily manufactured.

8. Notes

The present disclosure is not limited to the embodiment described above but may be modified in various ways, as illustrated below. In the following descriptions, like parts and components are designated by the same reference numerals to avoid duplicating descriptions. The following description will focus on points that differ from the above-described embodiment.

(8-1) Modifications on Ribbon Spool

Figure 18A:
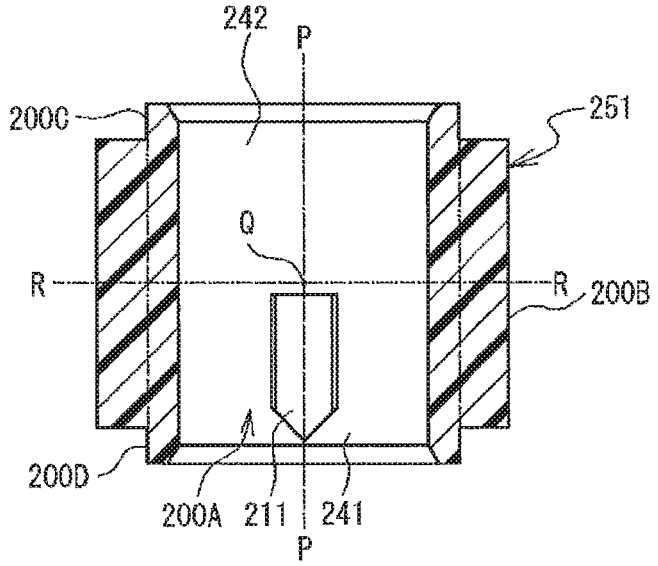
FIGS. 18A to 18C are vertical cross-sectional views of ribbon spools according to modifications.

The ribbon spool is not limited to the ribbon spool 200 in the above-described embodiment but may be modified in various ways. In a ribbon spool 251 illustrated in FIG. 18A, a single first protruding part 211 is provided on the lower inner surface 241. The first protruding part 211 of the ribbon spool 251 has the same shape as the first protruding parts 211 of the ribbon spool 200 (see FIG. 13). The ribbon spool 251 is not provided with the second protruding parts 212 and the third protruding part 213.

As illustrated in this modification, the ribbon spool should be provided with at least one first protruding part 211. The ribbon spool 200 may have an asymmetric shape in the direction along the axis P. The ribbon spool need not be provided with the second protruding parts 212 and third protruding part 213. In the latter case, the worker may use adhesive, screws, or the like to mount the rotating member 290 on the upper inner surface 242, for example.

Figure 18B:
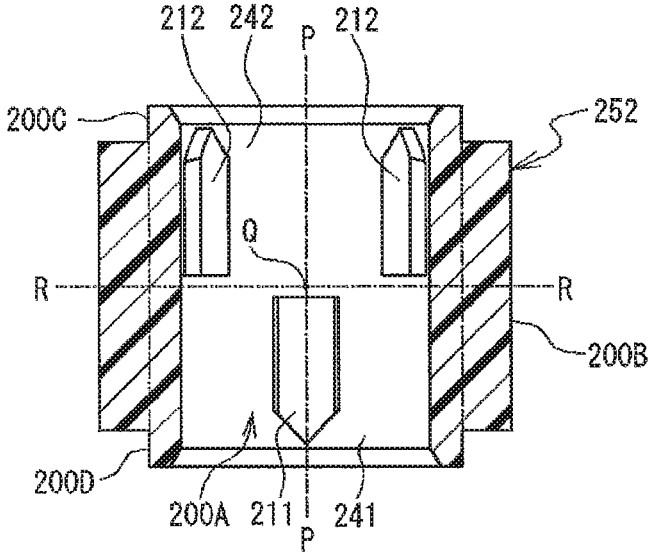

In a ribbon spool 252 illustrated in FIG. 18B, three first protruding parts 211 arranged at regular intervals along the circumferential direction are provided on the lower inner surface 241, and three second protruding parts 212 arranged at regular intervals along the circumferential direction are provided on the upper inner surface 242. The first protruding parts 211 and second protruding parts 212 of the ribbon spool 252 have the same shape as the corresponding first protruding parts 211 and second protruding parts 212 of the ribbon spool 200 (see FIG. 13). The ribbon spool 252 is not provided with the third protruding part 213. The three first protruding parts 211 are disposed at different circumferential positions from the three second protruding parts 212. Note that only one of the three first protruding parts 211 and only two of the three second protruding parts 212 are illustrated in FIG. 18B.

As described in this modification, the first protruding parts 211 and second protruding parts 212 need not be aligned with each other in the direction along the axis P. The ribbon spool also need not be provided with the third protruding part 213. In the latter case, when the rotating member 290 is inserted into the mounting hole 200A from above, the anchoring protrusions 293 are supported from below by the top ends of the first protruding parts 211. In this way, the rotating member 290 can be subjected to positioning within the mounting hole 200A in the direction along the axis P.

Note that in the ribbon spool 252, two first protruding parts 211 arranged at regular intervals in the circumferential direction may be provided on the lower inner surface 241, and two second protruding parts 212 arranged at regular intervals in the circumferential direction may be provided on the upper inner surface 242. In this case, the angle formed by two lines connecting both circumferential edges of the region between two neighboring first protruding parts 211 (i.e., the first groove part 221) and the axis P along the shortest respective distances is at least 1000. Thus, the interval in the circumferential direction between two neighboring first protruding parts 211 is not limited to 1000 or less in a ribbon spool provided with a plurality of first protruding parts 211.

Figure 18C:
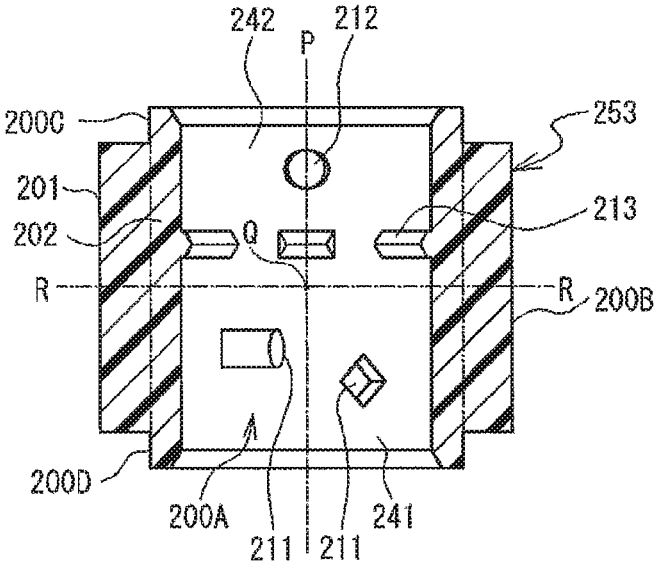

In a ribbon spool 253 illustrated in FIG. 18C, two first protruding parts 211 are provided on the lower inner surface 241. When viewed from the axis P, i.e., when viewed along a radial direction of the ribbon spool 253, one of the first protruding parts 211 has elliptical shape and remaining one of the first protruding parts has a rhombic column shape. Both first protruding parts 211 are positioned above the bottom edge region of the mounting hole 200A and are at different positions in the direction along the axis P. A single second protruding part 212 is provided on the upper inner surface 242. The second protruding part 212 has a circular column shape when viewed from the axis P and is disposed below the top edge region of the mounting hole 200A. A plurality of third protruding parts 213 arranged at regular intervals in the circumferential direction is provided between the lower inner surface 241 and upper inner surface 242. The third protruding parts 213 are rectangular shaped when viewed from the axis P and triangular column-shaped when viewed along the circumferential direction. Each third protruding part 213 is positioned above the center plane R. Each of the first protruding parts 211, the second protruding part 212, and each of the third protruding parts 213 have differing protruding lengths.

As described in this modification, the plurality of first protruding parts 211 may have different shapes from each other. The first protruding parts 211, second protruding parts 212, and third protruding parts 213 may also have different shapes from each other. The distance from the first protruding parts 211 to the spool center point Q may differ from the distance from the second protruding parts 212 to the spool center point Q. The first protruding parts 211 and second protruding parts 212 may be asymmetric about an imaginary point or imaginary plane centrally located between the two. The shortest distance from the radially protruding ends of the first protruding parts 211 to the axis P may also differ from the shortest distance from the radially protruding ends of the second protruding parts 212 to the axis P. The first protruding parts 211 need not extend to near the bottom edge of the lower inner surface 241. The second protruding parts 212 need not extend to near the top edge of the upper inner surface 242.

The third protruding parts 213 need not be disposed at the center position of the ribbon spool in the direction along the axis P. The radially protruding ends of the third protruding parts 213 need not extend in a direction along the axis P so as to cross the center position of the ribbon spool in the direction along the axis P. The first protruding parts 211 need not have surfaces that slope relative to the direction along the axis P. Note that the rotating member 290 and clutch spring 280 are also not limited to the embodiment described above. For example, the rotating member 290 need not be formed with the shaft hole 294 (see FIG. 12). In this case, the rotating member 290 may be provided with a recessed part in which the support shaft 141 (see FIG. 16) can be inserted.

(8-2) Modifications on Rotational Load Components

Figure 19A:
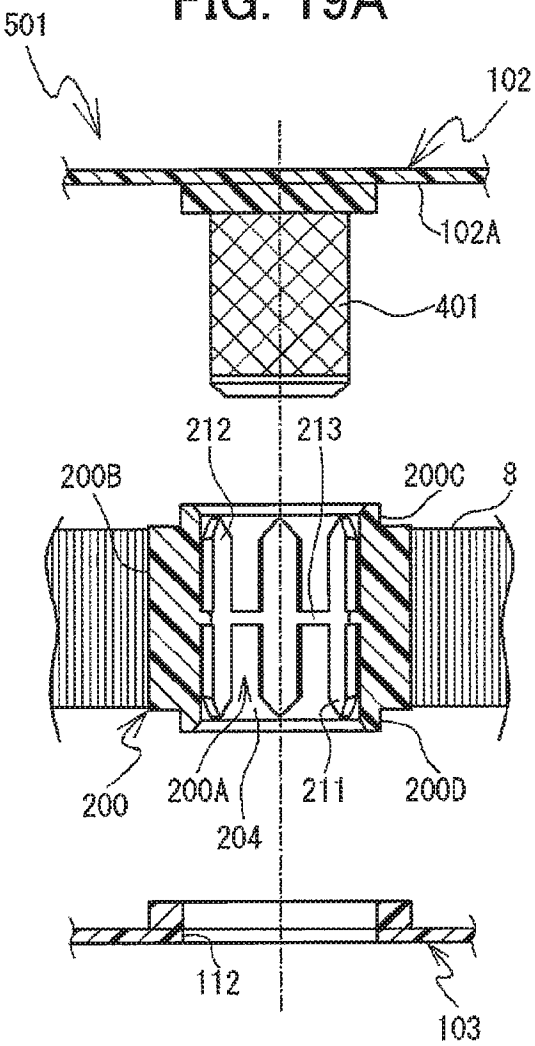
FIGS. 19A to 19C are views for description of ribbon cassettes according to modifications.
Figure 19B:
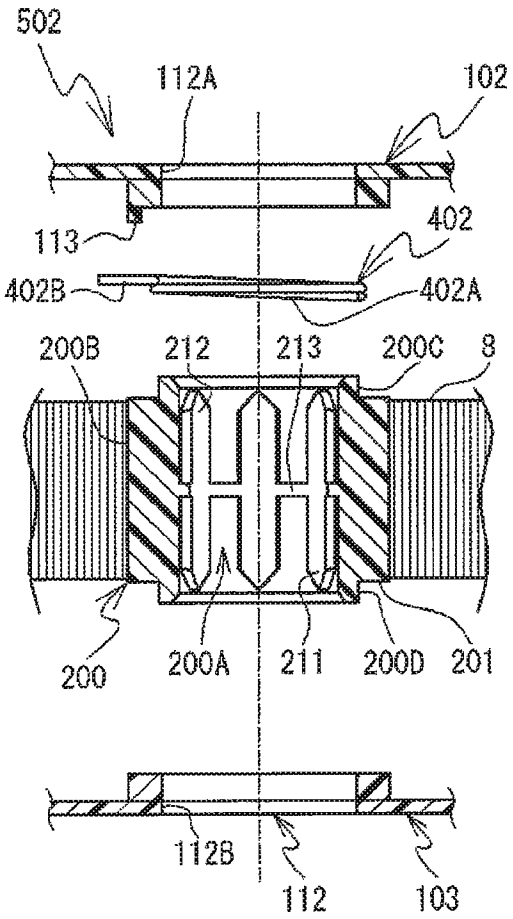
Figure 19C:
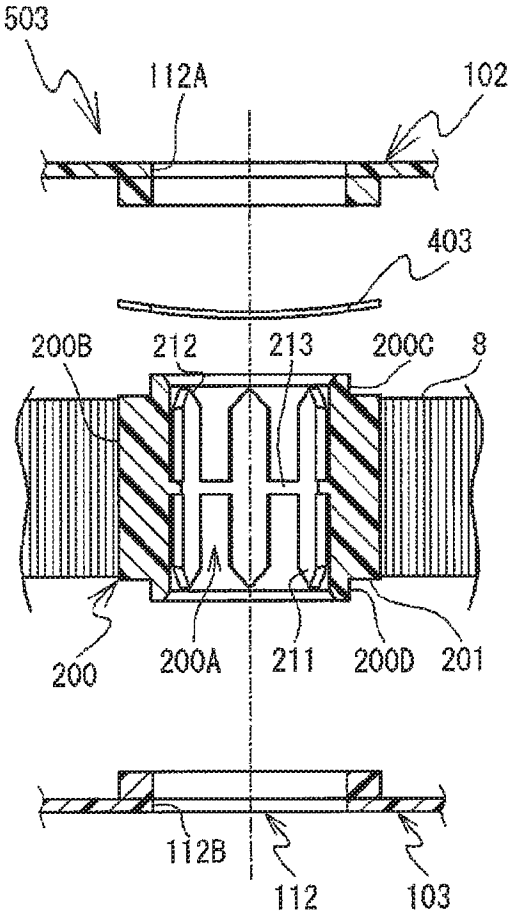

The rotational load components are not limited to the clutch spring 280 and rotating member 290 in the embodiment described above but may be modified in various ways. In modifications illustrated in FIGS. 19A to 19C, rotational load is applied to the ribbon spool 200 through the following structures without use of the clutch spring 280 and rotating member 290. FIGS. 19A to 19C illustrate the upper case 102, lower case 103, ribbon spool 200, and respective rotational load components according to the present modifications. These components are exploded in the vertical direction.

Figure 16:
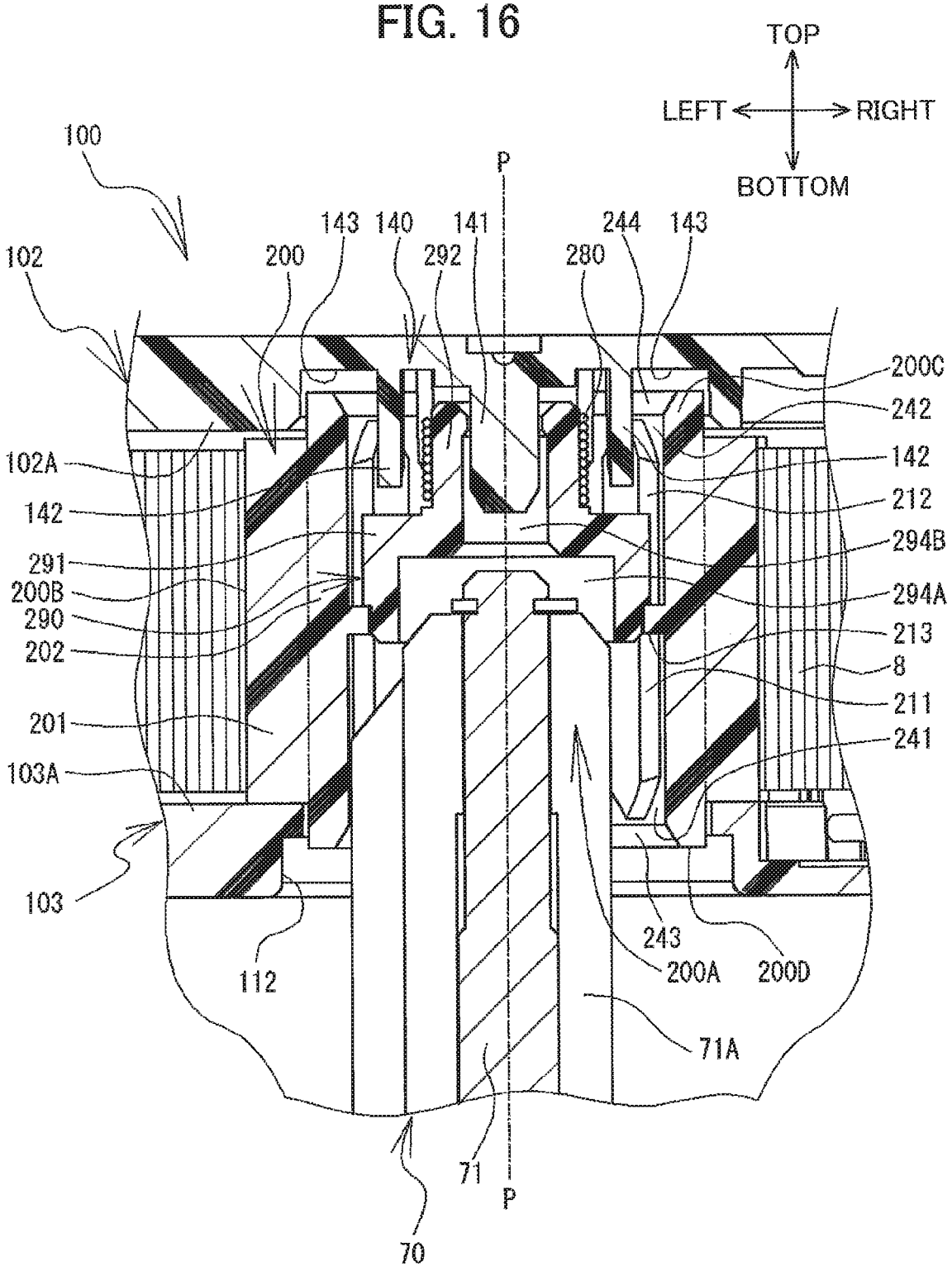
FIG. 16 is an enlarged cross-sectional view illustrating the ribbon spool 200 and its ambient components those illustrated in FIG. 4.

In a ribbon cassette 501 illustrated in FIG. 19A, a friction member 401 is provided in place of the support part 140 (see FIG. 16). The friction member 401 is a columnar elastic body that extends downward from the inner surface 102A of the upper case 102. For example, the friction member 401 may be a felt material having elasticity. The diameter of the friction member 401 is slightly larger than the diameter of the mounting hole 200A. Inside the ribbon cassette 510, the protruding part 200D is rotatably supported in the second support hole 112. The friction member 401 is inserted into the mounting hole 200A from above. The friction member 401 closely contacts the inner surface 204 through elastic deformation to conform to the shape of the inner surface 204.

With this structure, the ribbon spool 200 is rotatably supported about the friction member 401 inserted into the mounting hole 200A. When the ribbon spool 200 rotates, sliding friction is generated between the inner surface 204 and the friction member 401. This sliding friction applies a suitable rotational load to the ribbon spool 200. The worker can inspect the mounted state of the friction member 401 by visually examining the mounting hole 200A through the second support hole 112 and by manipulating the first protruding part 211 to rotate through the second support hole 112.

In a ribbon cassette 502 illustrated in FIG. 19B, the second support hole 112 includes an upper hole 112A, and a lower hole 112B. The upper hole 112A is provided in place of the support part 140 and is a circular hole that penetrates the upper case 102 vertically. The lower hole 112B corresponds to the second support hole 112 in the embodiment described above. The upper hole 112A and lower hole 112B have the same diameter and are aligned vertically. A clutch spring 402 has a similar structure to the clutch spring 280 (see FIG. 12). An annular part 402A of the clutch spring 402 is mounted around the outer circumferential surface of the protruding part 200C through the elastic force of the annular part 402A itself.

The protruding part 200D is inserted into the lower hole 112B and rotatably supported therein inside the ribbon cassette 502. The protruding part 200C is inserted into the upper hole 112A and rotatably supported therein. The clutch spring 402 is disposed between the peripheral edge of the upper hole 112A and the outer cylinder 201. The clutch spring 402 has an extension part 402B that engages with a columnar engaging part 113 provided on the peripheral edge portion of the upper hole 112A.

With the structure described above, the diameter of the annular part 402A expands when the ribbon spool 200 rotates in the draw-out direction, thereby applying a relatively light rotational load to the ribbon spool 200. When the ribbon spool 200 is rotated in the direction opposite the draw-out direction, the diameter of the annular part 402A contracts, thereby applying a relatively large rotational load to the ribbon spool 200. The worker can inspect the mounted state of the clutch spring 402 by manipulating the first protruding parts 211 to rotate through the lower hole 112B or by manipulating the second protruding parts 212 to rotate through the upper hole 112A.

A ribbon cassette 503 illustrated in FIG. 19C is similar to the ribbon cassette 502 described above in that the second support hole 112 includes the upper hole 112A and lower hole 112B. A disc spring 403 is provided around the outer circumference of the protruding part 200C. The disc spring 403 has an annular shape in a plan view and is configured of a thin plate having resiliency. The disc spring 403 is curved in a front view so as to protrude downward slightly. Inside the ribbon cassette 503, the protruding part 200D is inserted into the lower hole 112B and is rotatably supported therein. The protruding part 200C is inserted into the upper hole 112A and is rotatably supported therein. The disc spring 403 is disposed between the peripheral edge of the upper hole 112A and the outer cylinder 201. The disc spring 403 elastically contacts the peripheral edge of the upper hole 112A and the outer cylinder 201.

Through the structure described above, sliding friction is generated between the outer cylinder 201 and disc spring 403 when the ribbon spool 200 rotates. This sliding friction applies suitable rotational load to the ribbon spool 200. The worker can inspect the mounted state of the disc spring 403 by manipulating the first protruding parts 211 to rotate through the lower hole 112B or by manipulating the second protruding parts 212 to rotate through the upper hole 112A.

The various structural features described above in the preferred embodiment can be effected by replacing the clutch spring 280 and rotating member 290 with the rotational load components according to these modifications. For example, the structures detailed in (5-1) may be replaced as follows.

The ribbon cassettes 501-503 are provided with a box-shaped case 101 (see FIG. 7). The ink ribbon 8 is accommodated in the case 101. The cylindrical ribbon spool 200 is supported in the case 101 so as to be freely rotatable, and one end of the ink ribbon 8 is wound about the ribbon spool 200. The cylindrical take-up spool 300 is supported in the case 101 so as to be freely rotatable. The other end of the ink ribbon 8 is wound around the take-up spool 300. Elastic members (the friction member 401, clutch spring 402, and disc spring 403) contact the case 101 and ribbon spool 200. More specifically, the elastic members contact at least one of the ribbon cassette 100 and ribbon spool 200 in an elastically deformed state.

The ribbon spool 200 has the first protruding parts 211 disposed on the inner surface 204 of the ribbon spool 200. The first protruding parts 211 protrude in a radial direction that intersects the axis P of the ribbon spool 200. The case 101 has the second support hole 112. The second support hole 112 is a hole in which the ribbon spool 200 is fitted. More specifically, the second support hole 112 is a hole that communicates with the mounting hole 200A. At least part of the second support hole 112 overlaps the entire circular region surrounded by the rotational path of the radially protruding ends of the first protruding parts 211 in a direction along the axis P.

According to this structure, the elastic members serving as the rotational load components apply rotational load to the ribbon spool 200. The ink ribbon 8 is pulled from the ribbon spool 200 with stability, and suitable tension is applied to the ink ribbon 8 being pulled. Further, the mounting hole 200A is exposed to the outside of the case 101 through the second support hole 112. The worker can easily inspect units of the ribbon cassettes 501-503 to determine whether the rotational load components are properly mounted in the ribbon spool 200. The rotatable detection shaft 71 engages with the first protruding parts 211 when inserted into the mounting hole 200A through the second support hole 112, for example. The printing device 1 can identify the amount of ink ribbon 8 used during a printing operation based on the rotation amount of the rotatable detection shaft 71.

Note that the friction member 401 is an example of the elastic member that is fixed to one of the ribbon spool 200 and case 101 and that slidably contacts the other of the ribbon spool 200 and case 101. The clutch spring 402 is an example of the elastic member that is fixed to one of the ribbon spool 200 and case 101 and that contacts the other of the ribbon spool 200 and case 101 in an elastically deformed state. The disc spring 403 is an example of the elastic member that contacts both of the ribbon spool 200 and case 101 in an elastically deformed state.

(8-3) Modifications on Elastic Bodies

The elastic bodies that elastically contact the first ribbon roll 8A are not limited to the two elastic bodies 180 in the embodiment described above and may be modified in various ways. For example, the elastic bodies for elastically contacting the first ribbon roll 8A may be provided on the lower case 103 instead of the upper case 102. The elastic bodies for elastically contacting the first ribbon roll 8A may be provided on both the upper case 102 and lower case 103. In the latter case, the elastic bodies provided on the upper case 102 may be vertically symmetric or asymmetric to the elastic bodies provided on the lower case 103.

Figure 20A:
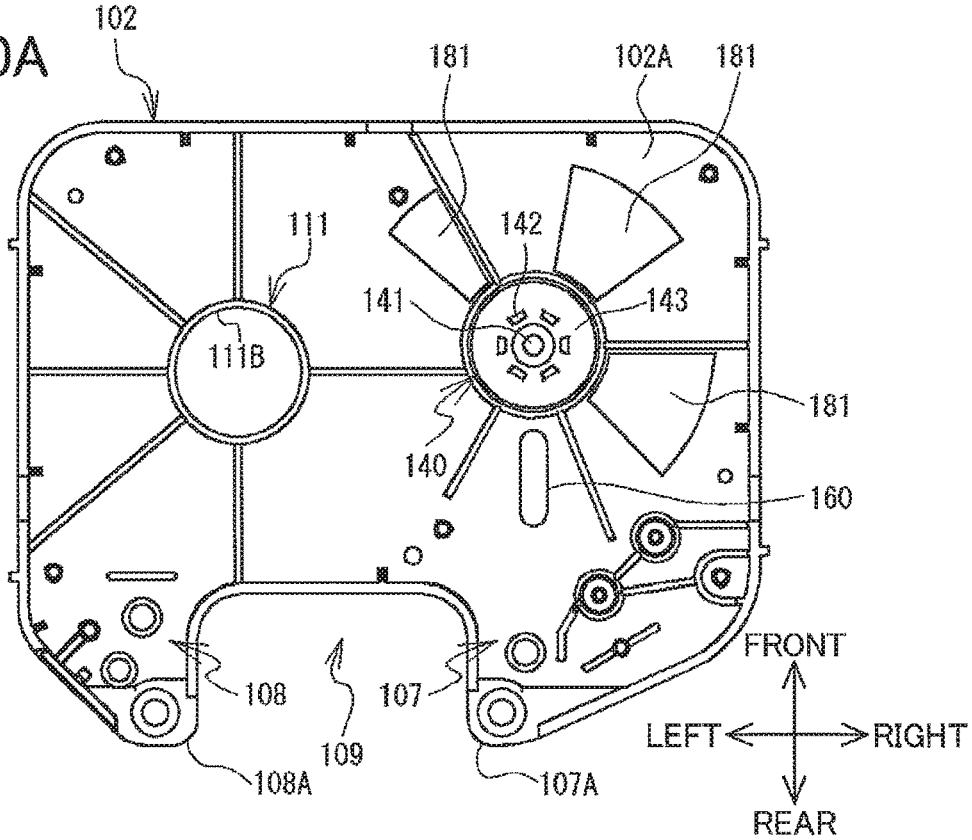
FIGS. 20A and 20B are bottom views of an upper case according to a modification.

As illustrated in FIG. 20A, three elastic bodies 181 may be provided in place of the two elastic bodies 180. The three elastic bodies 181 are all plate-shaped sponges that are similar to the elastic bodies 180, but differ from the elastic bodies 180 in the following point. The three elastic bodies 181 are arranged on the left-front side, right-front side, and right-rear side of the support part 140. The three elastic bodies 181 are also varied in shape. The elastic body 181 positioned on the left-front side of the support part 140 has a sector shape with the smallest dimension in the circumferential direction among the three elastic bodies 181. The elastic body 181 positioned on the right-rear side of the support part 140 has a sector shape with the largest dimension in the circumferential direction among the three elastic bodies 181.

Figure 20B:
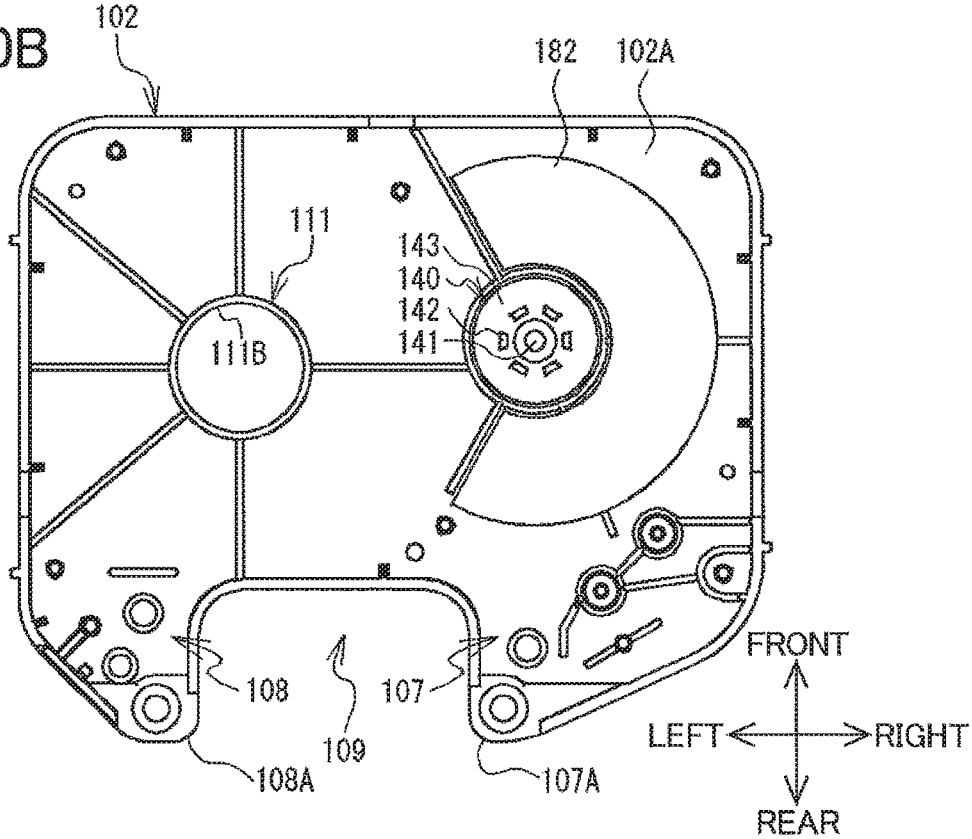

As illustrated in FIG. 20B, a single elastic body 182 may be provided in place of the two elastic bodies 180. In the present embodiment, the window part 160 is not provided. The elastic body 182 is a plate-shaped sponge similar to the elastic body 180, but differs from the elastic body 180 in the following point. The elastic body 182 has a sector shape that extends in the clockwise direction around the support part 140 in a bottom view from the left-front side to the left-rear side of the support part 140.

(8-4) Others

In the above-described embodiment and modifications, the ribbon cassettes 100, 501-503 are examples of "ribbon cassette" according to the disclosure. The direction of the axis P of the ribbon spool 200 is an example of "first direction" according to the disclosure. The radial direction of the ribbon spool 200 is an example of "second direction" according to the disclosure. Front-rear direction of the case

101 is an example of "third direction" according to the disclosure. Left-right direction of the case is an example of "fourth direction" according to the disclosure. Frontward, rearward, leftward, and rightward directions are examples of "fifth direction", "sixth direction", "seventh direction" and "eighth direction", respectively, according to the disclosure.

The case 101 is an example of "case" according to the disclosure. The ink ribbon 8 is an example of "ink ribbon" according to the disclosure. The first ribbon roll 8A is an example of "ribbon roll" according to the disclosure. The first ribbon roll 8A having maximum diameter is an example of "ribbon having maximum diameter" according to the disclosure. The right end portion of the first ribbon roll 8A having the maximum diameter is an example of "end in the eighth direction of the ribbon having maximum diameter" according to the disclosure. The ribbon spool 200 is an example of "first spool" according to the disclosure. The take-up spool 300 is an example of "second spool" according to the disclosure. The rotating member 290 is an example of "rotating member" according to the disclosure. The clutch spring 280 is an example of "clutch spring" according to the disclosure. The engaging part 142 is an example of "engaging part" according to the disclosure. The upper inner surface 242 is an example of "first inner surface" according to the disclosure. The lower inner surface 241 is an example of "second inner surface" according to the disclosure. The first protruding part 211 is an example of "specific protruding portion" according to the disclosure. The second support hole 112 is an example of "case hole" according to the disclosure. The friction member 401, the clutch spring 402, and the disc spring 403 are example of "elastic member" according to the disclosure.

The second protruding part 212 is an example of "engagement protrusion" according to the disclosure. The third protruding part 213 is an example of "contact protrusion" according to the disclosure. The shaft hole 294 is an example of "member hole" according to the disclosure. The head peripheral surface 106D is an example of "recessed portion" according to the disclosure. The head insertion section 109 is an example of "opening portion" according to the disclosure. The ribbon outlet 107A is an example of "communication opening" according to the disclosure. The bending parts 131-137 are examples of "plurality of bending parts" according to the disclosure. The bending parts 131-134 are examples of "first bending part" "second bending part", "third bending part" and "fourth bending part", respectively, according to the disclosure. The imaginary lines K1-K6 are examples of "first imaginary line", "second imaginary line", "third imaginary line", "fourth imaginary line", "fifth imaginary line", and "sixth imaginary line" respectively, according to the disclosure.

The center lines C1 and C2 are examples of "first center line", and "second center line", respectively, according to the disclosure. The positioning holes 121, 122 are examples of "first opening" and "second opening", respectively, according to the disclosure. The connecting line C3 is an example of "line connecting the first opening to the second opening" according to the disclosure. The indicators 191-193 and 195 are example of "at least one through-hole" according to the disclosure. The connecting line C4 is an example of "line crossing rotation axis of first spool and rotation axis of second spool" according to the disclosure. The indicators 191-193 are example of "first hole" according to the disclosure. The indicator 195 is an example of "second hole" according to the disclosure. The elastic members 180-182 are example of "elastic body" according to the disclosure.

In summary, the following aspects are provided in the present disclosure. According to one aspect of the disclosure, there is provided a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; a rotating member disposed in an interior of the first spool and engaged with a first inner surface which is a part of an inner surface of the first spool; a clutch spring including a coil like annular part attached to the rotating member, and an extension part extending from the annular part; and an engaging part provided in the case and positioned on a locus of rotation of the extension part. The first spool has a specific protruding portion provided at a second inner surface which is another part of the inner surface of the first spool and is positioned at a different position from a position of the first inner surface with respect to a first direction which is an extending direction of a rotation axis of the first spool, the specific protruding portion protruding in a second direction crossing the rotation axis of the first spool. The case has a case-hole positioned closer to the second inner surface than to the first inner surface, the case-hole having a portion overlapped in the first direction with an entire circular region surrounded by a path of rotation of a tip end portion in the second direction of the specific protruding portion, the case-hole being in communication with the interior of the first spool.

According to a second aspect of the disclosure, there is provided a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; a rotating member disposed in an interior of the first spool and engaged with a first inner surface which is a part of an inner surface of the first spool; a clutch spring including a coil like annular part attached to the rotating member, and an extension part extending from the annular part; and an engaging part provided in the case and positioned on a path of rotation of the extension part. The first spool has a specific protruding portion provided at a second inner surface which is another part of the inner surface of the first spool and is positioned at a different position from a position of the first inner surface with respect to a first direction which is an extending direction of a rotation axis of the first spool, the specific protruding portion protruding in a second direction crossing the rotation axis of the first spool. The case has a case-hole with which an end portion in the first direction of the first spool is fitted, the end portion of the first spool being closer to the second inner surface than to the first inner surface in the first direction.

According to a third aspect of the disclosure, there is a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; and an elastic member in contact with at least one of the first spool and the case with elastically deforming state. The first spool has a specific protruding portion provided at an inner surface of the first spool, the specific protruding portion protruding in a second direction crossing a rotation axis of the first spool, the rotation axis extending in a first direction. The case has a case-hole having a portion overlapped with an entire circular region surrounded by a path of rotation of a tip end portion in the second direction of the specific protruding portion, the case-hole being in communication with the interior of the first spool.

According to a fourth aspect of the disclosure, there is a ribbon cassette including: a box like case; an ink ribbon accommodated in an interior of the case; a first spool having hollow cylindrical shape and rotatably supported in the case, one end portion of the ink ribbon being wound over the first spool; a second spool having hollow cylindrical shape and rotatably supported in the case, another end portion of the ink ribbon being connected to the second spool; and an elastic member in contact with the first spool and the case with elastically deforming state. The first spool has a specific protruding portion provided at an inner surface of the first spool, the specific protruding portion protruding in a second direction crossing a rotation axis of the first spool, the rotation axis extending in a first direction. The case has a case hole with which the first spool is fitted.

In the above ribbon cassette, preferably, the case has lengths in the first direction, in a third direction perpendicular to the first direction, and in a fourth direction perpendicular to the first direction and the third direction, the fourth direction including a seventh direction and eighth direction directing opposite to each other. The rotation axis of the first spool is positioned forward, in the eighth direction, of a first center line extending in the third direction and passing through a center in the fourth direction of the case. A rotation axis of the second spool is positioned forward, in the seventh direction, of the first center line.

In the above ribbon cassette, preferably, the third direction includes a fifth direction and a sixth direction directing opposite to each other. The case has a first opening positioned forward in the sixth direction of a second center line extending in the fourth direction and passing through a center in the third direction of the case, and a second opening positioned forward of the second center line in the fifth direction.

In the above ribbon cassette, preferably, one of the first opening and the second opening is an elongated slot. The first opening and the second opening are arrayed in a longitudinal direction of the elongated slot.

In the above ribbon cassette, preferably, the rotation axis of the first spool is positioned forward in the eighth direction of a linear line connecting the first opening to the second opening. The rotation axis of the second spool is positioned forward of the linear line in the seventh direction.

In the above ribbon cassette, preferably, the case has a recessed portion extending across a central position of the case in the fourth direction and recessed in the fifth direction, an opening portion surrounded by the recessed portion and extending through the case in the first direction, a communication opening allowing the ink ribbon to pass therethrough, and providing communication between the opening portion and the interior of the case, and a first bending part having one of solid cylindrical shape and hollow cylindrical shape provided in the interior of the case, the first bending part being in contact with the ink ribbon taken out of the first spool and directing toward the communication opening to flex the ink ribbon and to guide the ink ribbon along a predetermined travelling passage. The first opening is positioned between the first bending part and the rotation axis of the first spool in the third direction.

In the above ribbon cassette, preferably, the case has a recessed portion extending across a central position of the case in the fourth direction and recessed in the fifth direction, an opening portion surrounded by the recessed portion and extending through the case in the first direction, a communication opening allowing the ink ribbon to pass therethrough, and providing communication between the opening portion and the interior of the case, and a first bending part having one of solid cylindrical shape and hollow cylindrical shape provided in the interior of the case, the first bending part being in contact with the ink ribbon taken out of the first spool and directing toward the communication opening to flex the ink ribbon and to guide the ink ribbon along a predetermined travelling passage. The first bending part is positioned between the first opening and the rotation axis of the first spool in the fourth direction.

In the above ribbon cassette, preferably, the case has a recessed portion extending across a central position of the case in the fourth direction and recessed in the fifth direction, an opening portion surrounded by the recessed portion and extending through the case in the first direction, a communication opening allowing the ink ribbon to pass therethrough, and providing communication between the opening portion and the interior of the case, and a plurality of bending parts including one of solid cylindrical members and hollow cylindrical members provided in the interior of the case, each cylindrical member being in contact with the ink ribbon taken out of the first spool and directing toward the communication opening to flex the ink ribbon and to guide the ink ribbon along a predetermined travelling passage. The first bending part is positioned between the recessed portion and the rotation axis of the first spool in the third direction.

In the above ribbon cassette, preferably, the case has lengths in the first direction, in a third direction perpendicular to the first direction, and in a fourth direction perpendicular to the first direction and the third direction. The case has at least one through-hole positioned between the first spool and the second spool in the fourth direction.

In the above ribbon cassette, preferably, the third direction includes a fifth direction and a sixth direction directing opposite to each other. The casing has a recessed portion extending across a central position of the case in the fourth direction and recessed in the fifth direction. The at least one through-hole is positioned forward, in the fifth direction of a liner line crossing the rotation axis of the first spool and the rotation axis of the second spool, and the at least one through-hole is aligned with the recessed portion in the third direction.

In the above ribbon cassette, preferably, the third direction includes a fifth direction and sixth direction directing opposite to each other, and the fourth direction includes a seventh direction and eighth direction directing opposite to each other. The at least one through-hole includes three first holes arrayed in the fourth direction, and a single second hole different from the first holes. The second hole is positioned forward, in the sixth direction of one of the three first holes which is positioned forward in the seventh direction of remaining two first holes.

In the above ribbon cassette, preferably, the case has lengths in the first direction, in a third direction perpendicular to the first direction, and in a fourth direction perpendicular to the first direction and the third direction, the third direction including a fifth direction and sixth direction directing opposite to each other. The rotation axis of the first spool is positioned forward of the rotation axis of the second spool in the fifth direction.

In the above ribbon cassette, preferably, the first spool has a symmetrical shape in the first direction.

In the above ribbon cassette, preferably, the specific protruding portion is positioned closer to the case hole than to the center position in the first direction of the first spool.

In the above ribbon cassette, preferably, the specific protruding portion provided at the first spool includes a plurality of specific protrusions arrayed in a circumferential direction of the first spool. Two neighboring specific protrusions define a region therebetween, the region having one end and another end in the circumferential direction, a shortest linear line connecting the one end of the region to the rotation axis of the first spool and a shortest another linear line connecting the another end of the region to the rotation axis of the first spool defining an angle of not more than 100 degrees.

In the above ribbon cassette, preferably, the specific protruding portion has surfaces sloping with respect to the first direction such that a length between the surfaces in a circumferential direction is gradually reduced toward the case hole.

In the above ribbon cassette, preferably, the elastic member is fixed to one of the first spool and the case, and is in contact with remaining one of the first spool and the case with elastically deforming state.

In the above ribbon cassette, preferably, the elastic member is fixed to one of the first spool and the case, and is in sliding contact with remaining one of the first spool and the case.

In the above ribbon cassette, preferably, the elastic member is in contact with the first spool and the case with elastically deforming state.

In the above ribbon cassette, preferably, the ribbon cassette further includes an elastic body disposed in the interior of the case, the elastic body being in elastic contact with a ribbon roll in the first direction, the ribbon roll being the ink ribbon wound over the first spool.

In the above ribbon cassette, preferably, the elastic body includes a plurality of elastic segments in elastic contact with peripheral positions of the ribbon roll, so that each elastic segment contacts each peripheral position.

In the above ribbon cassette, preferably, the elastic body includes a plurality of elastic segments identical to each other.

In the ribbon cassettes according to the first, second, third and fourth embodiments of the present disclosure, workers can easily inspect whether the component for applying rotational load to the ribbon spool is properly assembled on the basis of a unit or single ribbon cassette.

What is claimed is:

1. A ribbon cassette comprising:

a box like case;

an ink ribbon accommodated in an interior of the case;

a first spool having a cylindrical shape and rotatably supported in the case, one end portion of the ink ribbon being wound over the first spool, the first spool being rotatable about a first rotation axis extending in a first direction; and a second spool having a cylindrical shape and rotatably supported in the case, another end portion of the ink ribbon being connected to the second spool, the second spool being rotatable about a second rotation axis, wherein the first spool has a protruding portion provided at an inner surface of the first spool, the protruding portion protruding in a second direction crossing the first rotation axis, wherein the case has a case-hole in communication with the interior of the first spool, wherein the case has lengths in the first direction, in a third direction perpendicular to the first direction, and in a fourth direction perpendicular to both the first direction and the third direction, the third direction including a fifth direction and a sixth direction opposite to the fifth direction, the fourth direction including a seventh direction and an eighth direction opposite to the seventh direction, wherein the first rotation axis is positioned further in the eighth direction than a first center line, the first center line extending in the third direction and passing through a center in the fourth direction, of the case, wherein the second rotation axis is positioned further in the seventh direction than the first center line, and wherein the first rotation axis is positioned further in the fifth direction than the second rotation axis.

2. The ribbon cassette according to claim 1, wherein the case-hole has a portion overlapped with an entire circular region surrounded by a path of rotation of a tip end portion in the second direction of the protruding portion in the first direction.

3. The ribbon cassette according to claim 1, wherein the case-hole is a hole in which the first spool is fitted.

4. The ribbon cassette according to claim 1, wherein the case further has:

a first opening positioned further in the sixth direction than a second center line, the second center line extending in the fourth direction and passing through a center in the third direction of the case; and a second opening positioned further in the fifth direction than the second center line.

5. The ribbon cassette according to claim 4, wherein one of the first opening and the second opening is an elongated slot, and wherein the first opening and the second opening are arrayed in a longitudinal direction of the elongated slot.

6. The ribbon cassette according to claim 4, wherein the first rotation axis is positioned further in the eighth direction than a linear line connecting the first opening and the second opening, and wherein the second rotation axis is positioned further in the seventh direction than the linear line.

7. The ribbon cassette according to claim 4, wherein the case further has:

a recessed portion recessed in the fifth direction and extending across a central position in the fourth direction of the case;

an opening portion extending through the case in the first direction, the opening portion being surrounded by the recessed portion;

a communication opening allowing the ink ribbon to pass therethrough, and providing communication between the opening portion and the interior of the case; and a first bending part provided in the interior of the case and having one of a solid cylindrical shape and a hollow cylindrical shape, the first bending part contacting and bending the ink ribbon taken out of the first spool and directed toward the communication opening to thereby guide the ink ribbon along a predetermined travelling passage, and wherein the first opening is positioned between the first bending part and the first rotation axis in the third direction.

8. The ribbon cassette according to claim 4, wherein the case further has:

a recessed portion recessed in the fifth direction and extending across a central position in the fourth direction of the case;

an opening portion extending through the case in the first direction, the opening portion being surrounded by the recessed portion;

a communication opening allowing the ink ribbon to pass therethrough, and providing communication between the opening portion and the interior of the case; and a first bending part provided in the interior of the case and having one of a solid cylindrical shape and a hollow cylindrical shape, the first bending part contacting and bending the ink ribbon taken out of the first spool and directed toward the communication opening to thereby guide the ink ribbon along a predetermined travelling passage, and wherein the first bending part is positioned between the first opening and the first rotation axis in the fourth direction.

9. The ribbon cassette according to claim 4, wherein the case further has:

a recessed portion recessed in the fifth direction and extending across a central position in the fourth direction of the case;

an opening portion extending through the case in the first direction, the opening portion being surrounded by the recessed portion;

a communication opening allowing the ink ribbon to pass therethrough, the communication opening providing communication between the opening portion and the interior of the case; and a first bending part provided in the interior of the case and having one of a solid cylindrical shape and a hollow cylindrical shape, the first bending part contacting and bending the ink ribbon taken out of the first spool and directing toward the communication opening to thereby guide the ink ribbon along a predetermined travelling passage, and wherein the first bending part is positioned between the recessed portion and the first rotation axis in the third direction.

10. The ribbon cassette according to claim 1, wherein the case further has at least one through-hole positioned between the first spool and the second spool in the fourth direction.

11. The ribbon cassette according to claim 10, wherein the case further has a recessed portion recessed in the fifth direction and extending across a central position in the fourth direction of the case, and wherein the at least one through-hole is positioned further in the fifth direction than a liner line crossing both the first rotation axis and the second rotation axis, and the at least one through-hole and the recessed portion are arrayed in the third direction.

12. The ribbon cassette according to claim 10, wherein the at least one through-hole includes three first holes and a single second hole different therefrom, the three first holes being arrayed in the fourth direction, and wherein one of the three first holes is positioned further in the seventh direction than remaining two of the three first holes and the second hole is positioned further in the fifth direction than the one of the three first holes.

13. The ribbon cassette according to claim 1, wherein the protruding portion is positioned closer to the case-hole than to a center position in the first direction of the first spool.

14. The ribbon cassette according to claim 1, wherein the first spool has the protruding portion including a plurality of protrusions arrayed in a circumferential direction of the first spool, and wherein two neighboring protrusions define a region therebetween, the region having one end and another end in the circumferential direction, a shortest linear line connecting the one end of the region to the first rotation axis and another shortest linear line connecting the another end of the region to the first rotation axis defining an angle of not more than 100 degrees.

15. The ribbon cassette according to claim 1, wherein the protruding portion has surfaces sloping with respect to the first direction such that a length between the surfaces in a circumferential direction is gradually reduced toward the case-hole.

16. The ribbon cassette according to claim 1, further comprising at least one elastic body disposed in the interior of the case, the at least one elastic body being in elastic contact with a ribbon roll in the first direction, the ribbon roll being the ink ribbon wound over the first spool.

17. The ribbon cassette according to claim 16, wherein the at least one elastic body comprises a plurality of elastic bodies, the plurality of elastic bodies being in elastic contact with respective ones of peripheral portions of the ribbon roll, the peripheral portions of the ribbon roll being positioned in positions different from each other in a circumferential direction.

18. The ribbon cassette according to claim 16, wherein the at least one elastic body comprises a plurality of elastic bodies identical to each other.

19. The ribbon cassette according to claim 1, wherein the case further has:

a recessed portion recessed in the fifth direction and extending across a central position in the fourth direction of the case;

an opening portion extending through the case in the first direction, the opening portion being surrounded by the recessed portion;

a communication opening allowing the ink ribbon to pass therethrough, and providing communication between the opening portion and the interior of the case; and a plurality of bending parts provided in the interior of the case, each of the plurality of bending parts having one of a solid cylindrical shape and a hollow cylindrical shape, each of the plurality of bending parts contacting and bending the ink ribbon taken out of the first spool and directed toward the communication opening to thereby guide the ink ribbon along a predetermined travelling passage, wherein the first spool and the second spool are positioned further in the fifth direction than the recessed portion, wherein the plurality of bending part comprises a first bending part and a second bending part in contact with the ink ribbon at a position downstream of the first bending part in the travelling passage, wherein an end portion in the fifth direction of the first bending part is positioned further in the sixth direction than an end portion in the sixth direction of the first spool, wherein an end portion in the eighth direction of the first bending part is positioned further in the eighth direction than an end portion in the eighth direction of the first spool, wherein, in a maximum diameter state where the ink ribbon wound over the first spool has a maximum diameter defined by winding a predetermined maximum amount of ink ribbon over the first spool, the end portion in the eighth direction of the first bending part is positioned further in the seventh direction than an end portion in the eighth direction of the ink ribbon, wherein the first bending part has a circumferential surface including a first surface defining the travelling passage and the second bending part has a circumferential surface including a second surface defining the travelling passage, and wherein a first imaginary line is defined by a straight line which is tangent both to a point on the first surface and to a point on the second surface, a second imaginary line is defined by a straight line which is tangent to a point on the first surface and is perpendicular both to the first direction and to the first imaginary line, and the second imaginary line passes through a portion between an outer circumferential surface of the first spool and an outer circumferential surface of the ink ribbon that is at the maximum diameter state.

20. The ribbon cassette according to claim 19, wherein, of angles formed by the first imaginary line and a third imaginary line, one angle which defines a region where the first bending part is positioned is an acute angle, the third imaginary line being defined by a straight line which is tangent both to a point on the first surface and to a point on the outer circumferential surface of the ink ribbon that is at the maximum diameter state, and wherein, of angles formed by the first imaginary line and a fourth imaginary line, one angle which defines a region where the first bending part is positioned is an obtuse angle, the fourth imaginary line being defined by a straight line which is tangent both to a point on the first surface and to a point on the outer circumferential surface of the first spool.

21. The ribbon cassette according to claim 20, wherein the plurality of bending parts further comprises a third bending part and a fourth bending part, the third bending part being in contact with the ink ribbon at a position downstream of the second bending part in the travelling passage, the third bending part having a circumferential surface including a third surface defining the travelling passage, the fourth bending part being in contact with the ink ribbon at a position downstream of the third bending part in the travelling passage, the fourth bending part having a circumferential surface including a fourth surface defining the travelling passage, wherein, of angles formed by the first imaginary line and a fifth imaginary line, one angle which defines a region where the second bending part is positioned is an acute angle, the fifth imaginary line being defined by a straight line which is tangent both to a point on the second surface and to a point on the third surface, and wherein, of angles formed by the fifth imaginary line and a sixth imaginary line, one angle which defines a region where the third bending part is positioned is an acute angle, the sixth imaginary line being defined by a straight line which is tangent both to a point on the third surface and to a point on the fourth surface.

22. The ribbon cassette according to claim 21, wherein the first bending part and the second bending part are columnar bodies fixed to the case, and wherein the third bending part is a rotary body rotatable about an axis extending in the first direction.

23. The ribbon cassette according to claim 22, wherein the first bending part and the second bending part are integral with the case.

24. The ribbon cassette according to claim 22, wherein the ink ribbon has one surface coated with ink and an opposite surface, the ink ribbon being wound over the first spool such that the one surface is positioned radially inward of the opposite surface, wherein the first bending part and the second bending part are in contact with the opposite surface of the ink ribbon, and wherein the third bending part is in contact with the one surface of the ink ribbon.

25. The ribbon cassette according to claim 1, wherein the case further has a second case-hole in communication with an interior of the second spool.

26. The ribbon cassette according to claim 25, wherein the second case-hole is a hole in which the second spool is fitted.

* * * * *